US011492679B2

(12) United States Patent
Yokoi et al.

(10) Patent No.: US 11,492,679 B2
(45) Date of Patent: Nov. 8, 2022

(54) HOT-ROLLED STEEL SHEET AND METHOD FOR MANUFACTURING SAME

(71) Applicant: NIPPON STEEL CORPORATION, Tokyo (JP)

(72) Inventors: Tatsuo Yokoi, Tokyo (JP); Hiroshi Shuto, Tokyo (JP); Teruki Hayashida, Tokyo (JP); Jun Ando, Tokyo (JP); Mutsumi Sakakibara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/285,013

(22) PCT Filed: Oct. 21, 2019

(86) PCT No.: PCT/JP2019/041313
§ 371 (c)(1),
(2) Date: Apr. 13, 2021

(87) PCT Pub. No.: WO2020/080552
PCT Pub. Date: Apr. 23, 2020

(65) Prior Publication Data

US 2021/0395852 A1 Dec. 23, 2021

(30) Foreign Application Priority Data

Oct. 19, 2018 (JP) ..... JP2018-197936

(51) Int. Cl.
*C21D 6/00* (2006.01)
*C21D 8/02* (2006.01)
*C22C 38/00* (2006.01)
(Continued)

(52) U.S. Cl.
CPC ..... *C21D 9/46* (2013.01); *C21D 6/004* (2013.01); *C21D 6/005* (2013.01); *C21D 6/007* (2013.01);
(Continued)

(58) Field of Classification Search
CPC ..... C21D 6/005; C21D 6/008; C21D 8/0226; C21D 2211/001; C21D 2211/002;
(Continued)

(56) References Cited

U.S. PATENT DOCUMENTS 6,517,955 B1 2/2003 Takada
6,544,354 B1 4/2003 Kawano et al.
(Continued)

FOREIGN PATENT DOCUMENTS

CN 1310770 A 8/2001
CN 102834531 A 12/2012
(Continued)

OTHER PUBLICATIONS

"Metallic materials—Tensile testing—Method of test at room temperature", JIS Z 2241, 2011, total 37 pages.

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

This hot-rolled steel sheet has a predetermined chemical composition, in which in a case where the thickness is denoted by t, a metallographic structure at a t/4 position from the surface includes, by area fraction, 77.0% to 97.0% of bainite or tempered martensite, 0% to 5.0% of ferrite, 0% to 5.0% of pearlite, 3.0% or more of residual austenite, and 0% to 10.0% of martensite, in the metallographic structure, the average grain size excluding the residual austenite is 7.0 μm or less, the average number density of iron-based car-
(Continued)

bides having a diameter of 20 nm or more is $1.0\times10^6$ carbides/$mm^2$ or more, a tensile strength is 980 MPa or more, and an average Ni concentration on the surface is 7.0% or more.

15 Claims, 3 Drawing Sheets

(51) Int. Cl.

| | |
|---|---|
| ***C22C 38/02*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/58*** | (2006.01) |
| ***C21D 9/46*** | (2006.01) |
| ***C23G 1/08*** | (2006.01) |

(52) U.S. Cl.
CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/10* (2013.01); *C22C 38/12* (2013.01); *C22C 38/14* (2013.01); *C22C 38/16* (2013.01); *C22C 38/58* (2013.01); *C23G 1/08* (2013.01); *C21D 2211/001* (2013.01); *C21D 2211/002* (2013.01); *C21D 2211/008* (2013.01)

(58) Field of Classification Search
CPC ..... C21D 2211/008; C22C 38/001; C22C 38/002; C22C 38/005; C22C 38/008; C22C 38/02; C22C 38/06; C22C 38/10; C22C 38/12; C22C 38/14; C22C 38/16; C22C 38/58
USPC ..... 428/469
See application file for complete search history.

(56) References Cited

U.S. PATENT DOCUMENTS

| | | | | |
|---|---|---|---|---|
| 9,109,275 | B2 | 8/2015 | Morimoto | |
| 2004/0163735 | A1 | 8/2004 | Matsukawa et al. | |
| 2013/0048157 | A1 | 2/2013 | Ootsuka et al. | |
| 2015/0284818 | A1 | 10/2015 | Toyoda et al. | |
| 2015/0376730 | A1* | 12/2015 | Shuto ..... | B32B 15/18 148/333 |
| 2019/0003009 | A1 | 1/2019 | Kawata | |

FOREIGN PATENT DOCUMENTS

| | | | |
|---|---|---|---|
| CN | 108495943 | A | 9/2018 |
| JP | 59-219473 | A | 12/1984 |
| JP | 6-145894 | A | 5/1994 |
| JP | 11-61326 | A | 3/1999 |
| JP | 2004-218074 | A | 8/2004 |
| JP | 2005-179703 | A | 7/2005 |
| JP | 2008-202149 | A | 9/2008 |
| JP | 2012-251200 | A | 12/2012 |
| JP | 2015-124410 | A | 7/2015 |
| KR | 10-1996119 | B1 | 7/2019 |

* cited by examiner

| BASE STEEL SHEET Ni CONTENT | PREHEATING ZONE AIR RATIO 1.1 to 1.9 | PREHEATING ZONE AIR RATIO LESS THAN 1.1 |
|---|---|---|
| 0.01% |  |  |
| 0.02% |  |  |
| 0.04% |  |  |
| |  | |

HOT-ROLLED STEEL SHEET AND METHOD FOR MANUFACTURING SAME

TECHNICAL FIELD OF THE INVENTION

The present invention relates to a hot-rolled steel sheet and a method for manufacturing the same.

The present application claims priority based on Japanese Patent Application No. 2018-197936, filed in Japan on Oct. 19, 2018, the content of which is incorporated herein by reference.

RELATED ART

Recently, in order to reduce the amount of carbon dioxide gas ($CO_2$) emitted from a vehicle, reduction of weight of a vehicle body is promoted by using a high strength steel sheet. Further, in order to secure the safety of passengers, a high strength steel sheet has become widely used, in addition to a soft steel sheet, for a vehicle body.

Furthermore, recently, due to further tightening of fuel consumption regulations and environmental regulations for $NO_X$ or the like, the increase in plug-in hybrid vehicles and electric vehicles has been expected. In these next-generation vehicles, it is necessary to mount a large capacity battery, and it is necessary to further reduce the weight of the vehicle body. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

In order to further reduce the weight of the vehicle body, the replacement from a steel sheet to a light-weight material such as an aluminum alloy, a resin, and CFRP or further high-strengthening of a steel sheet may be an option. However, from the viewpoint of material cost and working cost, it is realistic to use an ultrahigh-strength steel sheet for popular cars on the assumption of mass production excluding luxury cars.

Here, in order to achieve both vehicle body weight reduction and collision resistance, an investigation has been conducted to make a member thin by using a high strength steel sheet. Therefore, steel sheets having both high strength and excellent formability are strongly desired, and some techniques have been conventionally proposed in order to meet these demands. Among these, steel sheets containing residual austenite exhibit excellent ductility due to transformation-induced plasticity (TRIP), and therefore many investigations have been conducted so far.

For example, Patent Document 1 discloses a high strength steel sheet having excellent collision resistant safety and formability, in which residual austenite having an average grain size of 5 μm or less is dispersed in ferrite having an average grain size of 10 μm or less. In the steel sheet containing residual austenite in the metallographic structure, while the austenite is transformed into martensite during working and large elongation is exhibited due to transformation-induced plasticity, the formation of hard martensite impairs hole expansibility. Patent Document 1 discloses that not only ductility but also hole expansibility are improved by refining the ferrite and the residual austenite.

Patent Document 2 discloses a high strength steel sheet having excellent elongation and stretch flangeability and having a tensile strength of 980 MPa or more, in which a second phase constituted of residual austenite and/or martensite is finely dispersed in crystal grains.

Patent Documents 3 and 4 disclose a high strength hot-rolled steel sheet having excellent ductility and stretch flangeability, and a method for manufacturing the same. Patent Document 3 discloses a method for manufacturing a high strength hot-rolled steel sheet having good ductility and stretch flangeability, and is a method including cooling a steel sheet to a temperature range of 720° C. or lower within 1 second after the completion of hot rolling, allowing the steel sheet to stay in a temperature range of higher than 500° C. and 720° C. or lower for a staying time of 1 to 20 seconds, and the coiling the steel sheet in a temperature range of 350° C. to 500° C. In addition, Patent Document 4 discloses an ultrahigh-strength hot-rolled steel sheet that has good ductility and stretch flangeability and includes bainite as a primary phase and an appropriate amount of polygonal ferrite and residual austenite, in which in a steel structure excluding the residual austenite, an average grain size of grains surrounded by grain boundaries having a crystal orientation difference of 15° or more is 15 μm or less.

On the other hand, recently, Life Cycle Assessment (LCA) has been attracting attention, and attention has been paid to the environmental load not only during driving of vehicles, but also during manufacture.

For example, in the coating of vehicle components, a zinc phosphate treatment, which is a kind of chemical conversion treatment, has been applied as a base treatment. The zinc phosphate treatment is low in cost and has excellent coating film adhesion and corrosion resistance. However, a zinc phosphate treatment liquid contains phosphoric acid as a main component and a metal component such as a zinc salt, a nickel salt, and a manganese salt. Therefore, there is a concern about the environmental load of phosphorus and metals of the waste liquid that is discarded after use. In addition, a large amount of sludge containing iron phosphate as a main component, which is precipitated in a chemical conversion treatment tank, has a large environmental load as industrial waste.

Therefore, recently, a zirconium-based chemical conversion treatment liquid has been used as a chemical conversion treatment liquid that can reduce the environmental load. The zirconium-based chemical conversion treatment liquid does not contain phosphate and does not require the addition of metal salts. Therefore, the amount of sludge generated is extremely small. For example, Patent Documents 5 and 6 discloses techniques for forming a chemical conversion film on a metal surface using a zirconium chemical conversion treatment liquid.

PRIOR ART DOCUMENT

Patent Document

[Patent Document 1] Japanese Unexamined Patent Application, First Publication No. H11-61326

[Patent Document 2] Japanese Unexamined Patent Application, First Publication No. 2005-179703

[Patent Document 3] Japanese Unexamined Patent Application, First Publication No. 2012-251200

[Patent Document 4] Japanese Unexamined Patent Application, First Publication No. 2015-124410

[Patent Document 5] Japanese Unexamined Patent Application, First Publication No. 2004-218074

[Patent Document 6] Japanese Unexamined Patent Application, First Publication No. 2008-202149

DISCLOSURE OF THE INVENTION

Problems to be Solved by the Invention

Even when a zirconium-based chemical conversion treatment liquid is used, corrosion resistance and coating film adhesion comparable to a zinc phosphate treatment can be obtained with a conventional high strength steel sheet up to a strength class of 780 MPa. However, since the amount of alloy elements contained is large in an ultrahigh-strength steel sheet having a tensile strength of 980 MPa or more, zirconium-based chemical conversion crystals are insufficiently adhere to the surface of the steel sheet, and thus good corrosion resistance and coating film adhesion cannot be obtained.

Further, in ultrahigh-strength steel sheets having excellent collision resistance including the steel sheets disclosed in the above-mentioned Patent Documents 1 to 4, a method for sufficiently improving coating film adhesion in a case where a zirconium-based chemical conversion treatment liquid is used has not yet been proposed.

The present invention has been devised in view of the above-mentioned problems, and an object of the present invention is to a hot-rolled steel sheet which is an ultrahigh-strength steel sheet having a tensile strength of 980 MPa or more, high press formability (ductility and stretch flangeability), and good toughness, and even in a case where a zirconium-based chemical conversion treatment liquid is used, has chemical convertibility and coating film adhesion equal to or higher than those in a case where a zinc phosphate chemical conversion treatment liquid is used, and a method for manufacturing the hot-rolled steel sheet capable of stably manufacturing the hot-rolled steel sheet.

Means for Solving the Problem

The present inventors have conducted an intensive investigation to solve the above problems and have obtained the following findings.

The present invention has been made based on these findings, and the gist thereof is as follows.

(1) A hot-rolled steel sheet according to an aspect of the present invention includes, as a chemical composition expressed by the average value in an entire sheet thickness direction, by mass %: C: 0.100% to 0.250%; Si: 0.05% to 3.00%; Mn: 1.00% to 4.00%; Al: 0.001% to 2.000%; Ni: 0.02% to 2.00%; Nb: 0% to 0.300%; Ti: 0% to 0.300%; Cu: 0% to 2.00%; Mo: 0% to 1.000%; V: 0% to 0.500%; Cr: 0% to 2.00%; Mg: 0% to 0.0200%; Ca: 0% to 0.0200%; REM: 0% to 0.1000%; B: 0% to 0.0100%; Bi: 0% to 0.020%; one or two or more of Zr, Co, Zn, and W: 0% to 1.000% in total; Sn: 0% to 0.050%; P: 0.100% or less; S: 0.0300% or less; 0: 0.0100% or less; N: 0.1000% or less; and a remainder including Fe and impurities, in which Expression (i) is satisfied, in a case where a thickness is denoted by t, a metallographic structure at a t/4 position from a surface includes, by area fraction, 77.0% to 97.0% of bainite or tempered martensite, 0% to 5.0% of ferrite, 0% to 5.0% of pearlite, 3.0% or more of residual austenite, and 0% to 10.0% of martensite, in the metallographic structure, the average grain size excluding the residual austenite is 7.0 μm or less, the average number density of iron-based carbides having a diameter of 20 nm or more is $1.0\times10^6$ carbides/$mm^2$ or more, a tensile strength is 980 MPa or more, and an average Ni concentration on the surface is 7.0% or more, $$0.05\% \le Si+Al \le 3.00\% \qquad \text{Expression (i)}$$

where each element shown in Expression (i) indicates mass % of the element contained in the hot-rolled steel sheet.

(2) The hot-rolled steel sheet according to (1) may contain, as the chemical composition, by mass %, Ni: 0.02% to 0.05%.

(3) In the hot-rolled steel sheet according to (1) or (2), an internal oxide layer may be present in the hot-rolled steel sheet, and the average depth of the internal oxide layer may be 5.0 μm or more and 20.0 μm or less from the surface of the hot-rolled steel sheet.

(4) In the hot-rolled steel sheet according to any one of (1) to (3), the standard deviation of an arithmetic average roughness Ra of the surface of the hot-rolled steel sheet may be 10.0 μm or more and 50.0 μm or less.

(5) The hot-rolled steel sheet according to any one of (1) to (4) may contain, as the chemical composition, by mass %, one or both of V: 0.005% to 0.500% and Ti: 0.005% to 0.300%.

(6) The hot-rolled steel sheet according to any one of (1) to (5) may contain, as the chemical composition, by mass %, one or two or more of Nb: 0.005% to 0.300%, Cu: 0.01% to 2.00%, Mo: 0.01% to 1.000%, B: 0.0001% to 0.0100%, and Cr: 0.01% or more and 2.00% or less.

(7) The hot-rolled steel sheet according to any one of (1) to (6) may contain, as the chemical composition, by mass %, one or two or more of Mg: 0.0005% to 0.0200%, Ca: 0.0005% to 0.0200%, and REM: 0.0005% to 0.1000%.

(8) A method for manufacturing a hot-rolled steel sheet according to another aspect of the present invention includes: heating a slab having the chemical composition according to (1) to 1150° C. or higher in a heating furnace which includes a regenerative burner and has at least a preheating zone, a heating zone, and a soaking zone; hot-rolling the heated slab so that a finish temperature is T2° C., which is obtained by Expression (ii), or higher and a cumulative rolling reduction in a temperature range of 850° C. to 1100° C. is 90% or more; starting primary cooling within 1.5 seconds after the hot-rolling of the heated steel sheet and cooling the hot-rolled steel sheet to a temperature T3° C., which is represented by Expression (iii), or lower at an average cooling rate of 50° C./sec or higher; when a temperature represented by Expression (iv) is T4° C., secondary cooling the steel sheet from a cooling stop temperature of the primary cooling to a coiling temperature of (T4−100)° C. to (T4+50)° C. at an average cooling rate of 10° C./sec or higher; and coiling the steel sheet at the coiling temperature, in which in the heating of the slab, an air ratio in the preheating zone is 1.1 to 1.9, $$T2(^\circ\text{C.}) = 868-396\times[C]-68.1\times[Mn]+24.6\times[Si]-36.1\times[Ni]-24.8\times[Cr]-20.7\times[Cu]+250\times[Al] \qquad \text{(ii)}$$

$$T3(^\circ\text{C.}) = 770-270\times[C]-90\times[Mn]-37\times[Ni]-70\times[Cr]-83\times[Mo] \qquad \text{(iii)}$$

$$T4(^\circ\text{C.}) = 591-474\times[C]-33\times[Mn]-17\times[Ni]-17\times[Cr]-21\times[Mo] \qquad \text{(iv)}$$

where an [element symbol] in each expression indicates the amount (mass %) of each element in the slab.

(9) In the method for manufacturing a hot-rolled steel sheet according to (8), in the heating of the slab, an air ratio in the heating zone may be 0.9 to 1.3.

(10) In the method for manufacturing a hot-rolled steel sheet according to (8) or (9), in the heating of the slab, an air ratio in the soaking zone may be 0.9 to 1.9.

(11) In the method for manufacturing a hot-rolled steel sheet according to (9) or (10), the air ratio in the preheating zone may be higher than the air ratio in the heating zone.

(12) The method for manufacturing a hot-rolled steel sheet according to any one of (8) to (10) may further include pickling the hot-rolled steel sheet after the coiling of the steel sheet using a 1 to 10 mass % hydrochloric acid solution at a temperature of 20° C. to 95° C. under a condition of a pickling time of 30 seconds or more and less than 60 seconds.

Effects of the Invention

According to the above aspects of the present invention, it is possible to provide a hot-rolled steel sheet which is an ultrahigh-strength steel sheet having a tensile strength of 980 MPa or more, high press formability (ductility and stretch flangeability), and good toughness, and even in a case where a zirconium-based chemical conversion treatment liquid is used, has chemical convertibility and coating film adhesion equal to or higher than those in a case where a zinc phosphate chemical conversion treatment liquid is used. Since the steel sheet according to the present invention has excellent chemical convertibility and coating film adhesion, the steel sheet has excellent corrosion resistance after coating. In addition, excellent ductility and stretch flangeability are also obtained. Therefore, the steel sheet according to the present invention is suitable for a component for a vehicle that requires high strength, formability, and corrosion resistance after coating.

EMBODIMENTS OF THE INVENTION

Figure 1:
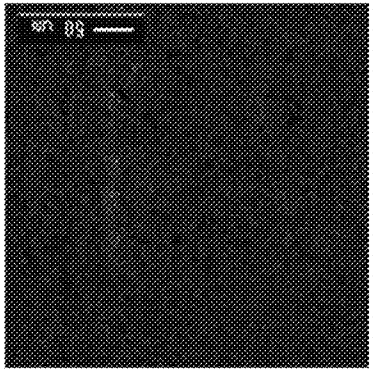
FIG. 1 is an example of EPMA measurement results of a surface of a hot-rolled steel sheet according to the embodiment and a comparative hot-rolled steel sheet (measurement conditions: acceleration voltage: 15 kV, irradiation current: $6\times10^{-8}$ A, irradiation time: 30 ms, and beam diameter: 1 μm).
Figure 1:
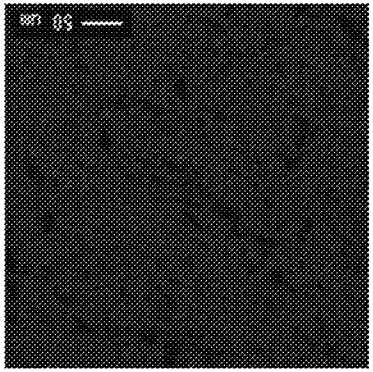
Figure 1:
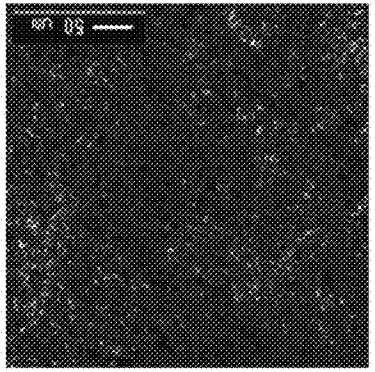
Figure 1:
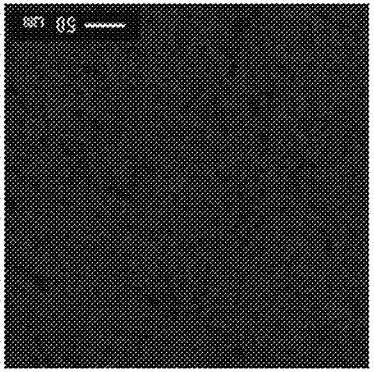
Figure 1:
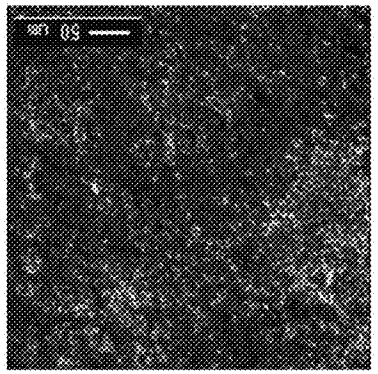
Figure 1:
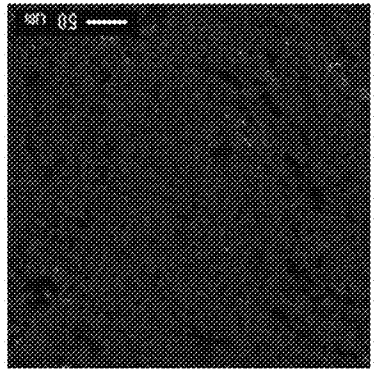
Figure 1:
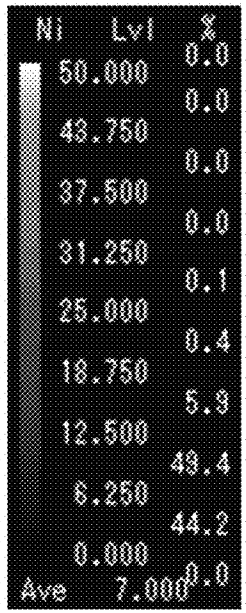

The present inventors have conducted an intensive investigation on the conditions under which good chemical convertibility and coating film adhesion can be stably obtained by a chemical conversion treatment using a zirconium-based chemical conversion treatment liquid on an ultrahigh-strength steel sheet having a tensile strength of 980 MPa or more, and sufficient ductility and stretch flangeability. As a result of the investigation, it has been found that the oxide on the surface layer of the steel sheet has a great effect on chemical convertibility and coating film adhesion.

The details are as follows.

A steel sheet is usually pickled before the chemical conversion treatment is performed. However, even when ordinary pickling is performed, oxides of Si, Al, and the like are formed on the surface of an ultrahigh-strength steel sheet, which deteriorates zirconium-based chemical convertibility and coating film adhesion. As a result of further investigation conducted by the present inventors, it has been found that in order to improve the chemical convertibility and the coating film adhesion, it is effective to form a Ni concentrated layer on the surface layer of the steel sheet as a precipitation nucleus of a zirconium-based chemical conversion crystal while suppressing the formation of oxides of Si, Al, and the like.

In addition, the present inventors have found that in a case where low cost and mass production are assumed in a step of manufacturing a general hot-rolled steel sheet, it is possible to form a Ni concentrated layer on the surface layer of the steel sheet after pickling (before a chemical conversion treatment) by containing the small amount of Ni and limiting the heating conditions in a heating step before hot rolling.

Hereinafter, a hot-rolled steel sheet according to an embodiment will be described in detail.

[Composition of Steel Sheet]

First, the reason for limiting the chemical composition of the hot-rolled steel sheet according to the embodiment will be described. Unless otherwise specified, % with respect to the amount of the component indicates mass %.

In addition, the display of the element name used in each expression in the present specification indicates the amount (mass %) of the element in the steel sheet, and in a case where the element is not contained, 0 is substituted.

C: 0.100% to 0.250%

C has an effect of promoting the formation of bainite and also has an effect of stabilizing residual austenite. When the C content is less than 0.100%, it is difficult to obtain the desired bainite area fraction and the desired residual austenite area fraction. Therefore, the C content is set to 0.100% or more. The C content is preferably 0.120% or more or 0.150% or more.

On the other hand, when the C content is more than 0.250%, pearlite is preferentially formed and bainite and residual austenite form insufficiently, and thus it is difficult to obtain the desired bainite area fraction and the desired residual austenite area fraction. Therefore, the C content is set to 0.250% or less. The C content is preferably 0.220% or less or 0.200% or less.

Si: 0.05% to 3.00%

Si has an effect of delaying the precipitation of cementite. By this effect, the amount of austenite remaining in an untransformed state, that is, the area fraction of the residual austenite can be enhanced, and the strength of the steel sheet can be increased by solid solution strengthening. In addition, Si has an effect of making the steel sound by deoxidation (suppressing the occurrence of defects such as blow holes in the steel). When the Si content is less than 0.05%, the effect cannot be obtained. Therefore, the Si content is set to 0.05% or more. The Si content is preferably 0.50% or more or 1.00% or more.

On the other hand, when the Si content is more than 3.00%, the surface properties, chemical convertibility, ductility, and weldability of the steel sheet are remarkably deteriorated, and the A3 transformation point is remarkably increased. This makes it difficult to perform hot rolling in a stable manner. Therefore, the Si content is set to 3.00% or less. The Si content is preferably 2.70% or less or 2.50% or less.

Mn: 1.00% to 4.00%

Mn has an effect of suppressing ferritic transformation to promote the formation of bainite. When the Mn content is less than 1.00%, the desired area fraction of bainite cannot be obtained. Therefore, the Mn content is set to 1.00% or more. The Mn content is preferably 1.50% or more and more preferably 1.80% or more.

On the other hand, when the Mn content is more than 4.00%, the completion of the bainitic transformation is delayed, the carbon concentration to austenite is not promoted, and residual austenite is insufficiently formed. Thus, it is difficult to obtain the desired area fraction of residual austenite. Therefore, the Mn content is set to 4.00% or less. The Mn content is preferably 3.70% or less or 3.50% or less.

Ni: 0.02% to 2.00%

Ni is one of the important elements in the hot-rolled steel sheet according to the embodiment. Ni is concentrated in the vicinity of the surface of the steel sheet near the interface between the surface of the steel sheet and the scale under specific conditions mainly in the heating step of the hot rolling step. When the zirconium-based chemical conversion treatment is performed on the surface of the steel sheet, this Ni acts as a precipitation nucleus of the zirconium-based chemical conversion film, and promotes the formation of a film having no lack of hiding and good adhesion. When the Ni content is less than 0.02%, the effect is not exhibited and thus the Ni content is set to 0.02% or more. The above effect of improving adhesion can be obtained not only for a zirconium-based chemical conversion film, but also for a conventional zinc phosphate chemical conversion film. In addition, the adhesion to the hot-dip galvanized layer by hot-dip galvanizing and the base metal of the alloyed galvanized layer that is alloyed after plating is also improved.

On the other hand, when the Ni content is more than 2.00%, not only the effect is saturated, but also the alloy cost is increased. Therefore, the Ni content is set to 2.00% or less. The Ni content is preferably 0.50% or less, 0.20% or less, or 0.05% or less.

Al: 0.001% to 2.000%

Like Si, Al has an effect of deoxidizing the steel to make the steel sheet sound. In addition, Al has an effect of suppressing the precipitation of cementite from austenite and promote the formation of residual austenite. When the Al content is less than 0.001%, the effect cannot be obtained. Therefore, the Al content is set to 0.001% or more. The Al content is preferably 0.010% or more.

On the other hand, when the Al content is more than 2.000%, the above effect is saturated, which is not economically preferable. Therefore, the Al content is set to 2.000% or less. The Al content is preferably 1.500% or less or 1.300% or less.

P: 0.100% or less

P is an element that is generally contained as an impurity and is also an element having an effect of enhancing the strength by solid solution strengthening. Although P may be positively contained, P is an element that is easily segregated, and when the P content is more than 0.100%, the formability and toughness are significantly decreased due to the grain boundary segregation. Therefore, the P content is limited to 0.100% or less. The P content is preferably 0.030% or less. The lower limit of the P content does not need to be particularly specified, but is preferably 0.001% from the viewpoint of refining cost.

S: 0.0300% or less

S is an element that is contained as an impurity. S forms sulfide-based inclusions in the steel and decreases the formability of the hot-rolled steel sheet. When the S content is more than 0.0300%, the formability is significantly decreased. Therefore, the S content is limited to 0.0300% or less. The S content is preferably 0.0050% or less. The lower limit of the S content does not need to be particularly specified, but is preferably 0.0001% from the viewpoint of refining cost.

N: 0.1000% or less

N is an element that is contained in the steel as an impurity and is an element that decreases the formability of the steel sheet. When the N content is more than 0.1000%, the formability of the steel sheet is significantly decreased. Therefore, the N content is set to 0.1000% or less. The N content is preferably 0.0800% or less and more preferably 0.0700% or less. Although the lower limit of the N content does not need to be particularly specified, as will be described later, in a case where one or two or more of Ti and V are contained to refine the metallographic structure, the N content is preferably 0.0010% or more and more preferably 0.0020% or more to promote the precipitation of carbonitride.

O: 0.0100% or less

When a large amount of O is contained in the steel, O forms a coarse oxide that becomes the origin of fracture, and causes brittle fracture and hydrogen-induced cracks. Therefore, the O content is limited to 0.0100% or less. The O content is preferably 0.0080% or less and 0.0050% or less. The O content may be 0.0005% or more or 0.0010% or more to disperse a large number of fine oxides when the molten steel is deoxidized.

The remainder of the chemical composition of the hot-rolled steel sheet according to the embodiment basically includes Fe and impurities, and in addition to the above elements, the hot-rolled steel sheet according to the embodiment may contain Nb, Ti, V, Cu, Cr, Mo, B, Ca, Mg, REM, Bi, Zr, Co, Zn, W, and Sn as optional elements. In a case where the above optional elements are not contained, the amount thereof is 0%. Hereinafter, the above optional elements will be described in detail.

In the embodiment, the impurities mean those mixed from ore as a raw material, scrap, manufacturing environment, and the like, and are allowed within a range that does not adversely affect the hot-rolled steel sheet according to the embodiment.

Nb: 0% to 0.300%

Nb is an element that contributes to improvement in low temperature toughness through the refinement of the grain size of the hot-rolled steel sheet by forming carbonitride or delaying the grain growth at the time of hot rolling by solute Nb. In a case where this effect is obtained, the Nb content is preferably set to 0.005% or more.

On the other hand, even when the Nb content is more than 0.300%, the above effect is saturated and the economic efficiency is decreased. Therefore, even in a case where Nb is contained as necessary, the Nb content is set to 0.300% or less.

One or both selected from the group consisting of Ti: 0% to 0.300% and V: 0% to 0.500%

Both Ti and V are precipitated as carbides or nitrides in the steel and have an effect of refining the metallographic structure by an pinning effect. Therefore, one or both of these elements may be contained. In order to more reliably obtain the effect, it is preferable that the Ti content is set to 0.005% or more, or the V content is set to 0.005% or more. However, even when these elements are excessively contained, the effect is saturated, which is not economically preferable. Therefore, even in a case where these element are contained, the Ti content is set to 0.300% or less, and the V content is set to 0.500% or less.

One or two or more selected from the group consisting of Cu: 0% to 2.00%, Cr: 0% to 2.00%, Mo: 0% to 1.000%, and B: 0% to 0.0100%.

All of Cu, Cr, Mo, and B have an effect of enhancing hardenability. In addition, Cr has an effect of stabilizing residual austenite, and Cu and Mo have an effect of precipitating carbides in the steel to increase the strength.

Cu has an effect of enhancing hardenability and an effect of precipitating as carbide in the steel at a low temperature to enhance the strength of the steel sheet. In order to more reliably obtain the effect, the Cu content is preferably 0.01% or more and more preferably 0.03% or more or 0.05% or more. However, when the Cu content is more than 2.00%, grain boundary cracks may occur in the slab in some cases. Therefore, the Cu content is set to 2.00% or less. The Cu content is preferably 1.50% or less and 1.00% or less.

Cr has an effect of enhancing hardenability and an effect of stabilizing residual austenite. In order to more reliably obtain the effect, the Cr content is preferably 0.01% or more or 0.05% or more. However, when the Cr content is more than 2.00%, the chemical convertibility of the steel sheet is significantly decreased. Accordingly, the Cr content is set to 2.00% or less.

Mo has an effect of enhancing hardenability and an effect of precipitating carbides in the steel to enhance the strength. In order to more reliably obtain the effect, the Mo content is preferably 0.010% or more or 0.020% or more. However, even when the Mo content is more than 1.000%, the effect is saturated, which is not economically preferable. Therefore, the Mo content is set to 1.000% or less. The Mo content is preferably 0.500% or less and 0.200% or less.

B has an effect of enhancing hardenability. In order to more reliably obtain the effect, the B content is preferably 0.0001% or more or 0.0002% or more. However, when the B content is more than 0.0100%, the formability of the steel sheet is significantly decreased, and thus the B content is set to 0.0100% or less. The B content is preferably 0.0050% or less.

One or two or more selected from the group consisting of Ca: 0% to 0.0200%, Mg: 0% to 0.0200%, and REM: 0% to 0.1000%

All of Ca, Mg, and REM have an effect of enhancing the formability of the steel sheet by adjusting the shape of inclusions to a preferable shape. Therefore, one or two or more of these elements may be contained. In order to more reliably obtain the effect, it is preferable that the amount of any one or more of Ca, Mg, and REM is 0.0005% or more. However, when the Ca content or Mg content is more than 0.0200%, or when the REM content is more than 0.1000%, the inclusions are excessively formed in the steel, and thus the formability of the steel sheet may be decreased in some cases. Therefore, the Ca content and Mg content are set to 0.0200% or less, and the REM content is set to 0.1000% or less.

Here, REM refers to a total of 17 elements made up of Sc, Y and lanthanoid, and the REM content refers to the total amount of these elements. In the case of lanthanoid, lanthanoid is industrially added in the form of misch metal.

Bi: 0% to 0.020%

Since Bi has an effect of enhancing formability by refining the solidification structure, Bi may be contained in the steel. In order to more reliably obtain the effect, the Bi content is preferably 0.0005% or more. However, even when the Bi content is more than 0.020%, the effect is saturated, which is not economically preferable. Therefore, the Bi content is set to 0.020% or less. The Bi content is preferably 0.010% or less.

One or two or more of Zr, Co, Zn, and W: 0% to 1.000% in total

Sn: 0% to 0.050%

Regarding Zr, Co, Zn, and W, the present inventors have confirmed that even when the total amount of these elements is 1.000% or less, the effect of the hot-rolled steel sheet according to the embodiment is not impaired. Therefore, the total amount of one or two or more of Zr, Co, Zn, and W may be 1.000% or less.

In addition, the present inventors have confirmed that the effect of the hot-rolled steel sheet according to the embodiment is not impaired even when a small amount of Sn is contained, but when Sn is contained, flaws are generated at the time of hot rolling. Thus, the Sn content is set to 0.050% or less.

$0.05\% \leq Si+Al \leq 3.00\%$

In the hot-rolled steel sheet according to the embodiment, it is necessary to control the amount of each element to be within the above ranges and then control Si+Al so as to satisfy Expression (1).

$$0.05\% \leq Si+Al \leq 3.00\% \quad \text{Expression (1)}$$

When Si+Al is less than 0.05%, scale related defects such as scale and spindle scale occur.

On the other hand, when Si+Al is more than 3.00%, the effect of improving the chemical convertibility and the coating film adhesion is not exhibited even in a case where Ni is contained.

The amount of each element in the hot-rolled steel sheet described above is the average amount in the total sheet thickness obtained by ICP emission spectroscopic analysis using chips according to HS G1201:2014.

[Metallographic Structure of Steel Sheet]

Next, the metallographic structure (microstructure) of the hot-rolled steel sheet according to the embodiment will be described.

In the hot-rolled steel sheet according to the embodiment, the metallographic structure at a sheet thickness ¼ depth position (t/4 in a case where the sheet thickness is denoted by t (mm)) from the surface of the steel sheet in the cross section parallel to the rolling direction of the steel sheet contains, by area fraction (area %), a total of 77.0% to 97.0% of bainite and tempered martensite, 0% to 5.0% of ferrite, 0% to 5.0% of pearlite, 3.0% or more of residual austenite, and 0% to 10.0% of martensite, so that a tensile strength of 980 MPa or more and high press formability (ductility and stretch flangeability) can be obtained. In the embodiment, the reason for defining the metallographic structure at a sheet thickness ¼ depth position from the surface of the steel sheet in the cross section parallel to the rolling direction of the steel sheet is that the metallographic structure at this position is a typical metallographic structure of the steel sheet.

Total area fraction of bainite and tempered martensite: 77.0% to 97.0%

Bainite and tempered martensite are the most important metallographic structures in this embodiment.

Bainite is an aggregation of lath-shaped crystal grains. The bainite includes upper bainite which includes carbides between laths and is an aggregation of laths, and lower bainite which contains iron-based carbides having a major axis of 5 nm or more inside thereof. The iron-based carbides precipitated in the lower bainite belong to a single variant, that is, an iron-based carbide group extending in the same direction. The tempered martensite is an aggregation of lath-shaped crystal grains and contains iron-based carbides having a major axis of 5 nm or more inside thereof. The iron-based carbides in the tempered martensite belong to a plurality of variants, that is, a plurality of iron-based carbide groups extending in different directions. Since it is difficult to distinguish between lower bainite and tempered martensite by the measurement method described later, it is not necessary to distinguish between the lower bainite and the tempered martensite in the embodiment.

As described above, bainite and tempered martensite are hard and homogeneous metallographic structures, which are the most suitable metallographic structures for steel sheets to have both high strength and excellent stretch flangeability. When the total area fraction of bainite and tempered martensite is less than 77.0%, the steel sheet cannot have both high strength and excellent stretch flangeability. Therefore, the total area fraction of the bainite and the tempered martensite is 77.0% or more. The total area fraction of bainite and tempered martensite is preferably 85.0% or more and more preferably 90.0% or more. Since the hot-rolled steel sheet according to the embodiment contains 3.0% or more of residual austenite, the total area fraction of bainite and tempered martensite is 97.0% or less.

Area fraction of ferrite: 0% to 5.0%

The ferrite is a massive crystal grain and is a metallographic structure in which a substructure such as lath is not contained inside thereof. When the area fraction of soft ferrite is more than 5.0%, the interface between ferrite and bainite or tempered martensite, and the interface between ferrite and residual austenite, which are likely to be the origins of voids, are increased. Thus, particularly, the stretch flangeability of the steel sheet is decreased. Therefore, the area fraction of the ferrite is set to 5.0% or less. The area fraction is preferably 4.0% or less, 3.0% or less, or 2.0% or less. It is preferable to reduce the area fraction of ferrite as much as possible to improve the stretch flangeability of the steel sheet, and the lower limit thereof is 0%.

Area fraction of pearlite: 0% to 5.0%

The pearlite has a lamellar metallographic structure in which cementite is precipitated in layers between the ferrite grains, and is a soft metallographic structure compared to the bainite. When the area fraction of the pearlite is more than 5.0%, the interface between the pearlite and the bainite or tempered martensite and the interface between the pearlite and the residual austenite, which are likely to be the origins of voids, are increased. Thus, particularly, the stretch flangeability of the steel sheet is decreased. Therefore, the area fraction of the pearlite is set to 5.0% or less. The area fraction of the pearlite is preferably 4.0% or less, 3.0% or less, or 2.0% or less. It is preferable to reduce the area fraction of the pearlite as much as possible to improve the stretch flangeability of the steel sheet, and the lower limit thereof is 0%.

Area fraction of martensite: 0% to 10.0%

In the embodiment, the martensite is defined as a metallographic structure in which carbides having a diameter of 5 nm or more are not precipitated between the laths and inside the laths. The martensite (so-called fresh martensite) is a very hard structure and greatly contributes to an increase in the strength of steel sheet. On the other hand, when the martensite is contained, the interface between the martensite and the bainite and the tempered martensite as primary phases becomes the origins of voids, and the stretch flangeability of the steel sheet is particularly decreased. Further, since the martensite has a hard structure, the low temperature toughness of the steel sheet is deteriorated. Therefore, the area fraction of the martensite is set to 10.0% or less. Since the hot-rolled steel sheet according to the embodiment includes a predetermined amount of bainite and tempered martensite, it is possible to secure the desired strength even in a case where the martensite is not contained. In order to obtain the desired stretch flangeability of the steel sheet, the area fraction of the martensite is preferably reduced as much as possible, and the lower limit thereof is 0%.

The identification of the metallographic structures of the bainite, tempered martensite, ferrite, pearlite, and martensite, which constitute the metallographic structure of the hot-rolled steel sheet according to the embodiment as described above, and the confirmation of the presence positions, and the measurement of the area fractions are performed by the following methods.

First, a Nital reagent and the reagent disclosed in Japanese Unexamined Patent Application, First Publication No. S59-219473 are used to corrode a cross section of the steel sheet parallel to the rolling direction. Regarding the etching of the cross section, specifically, a solution prepared by dissolving 1 to 5 g of picric acid in 100 ml of ethanol is used as solution A, and a solution prepared by dissolving 1 to 25 g of sodium thiosulfate and 1 to 5 g of citric acid in 100 ml of water is used as a solution B. A liquid mixture in which the solution A and the solution B are mixed at a ratio of 1:1 is prepared and a liquid prepared by adding and mixing nitric acid at a ratio of 1.5 to 4% with respect to the total amount of the liquid mixture is used as a pretreatment liquid. In addition, a liquid prepared by adding and mixing the pretreatment liquid into a 2% Nital solution at a ratio of 10% with respect to the total amount of the 2% Nital solution is used as a post treatment liquid. The cross section of the steel sheet parallel to the rolling direction is immersed in the pretreatment liquid for 3 to 15 seconds, washed with alcohol, and dried. Then, the cross section is immersed in the post treatment liquid for 3 to 20 seconds, then washed with water, and dried to corrode the cross section.

Next, each phase in the metallographic structure is identified based on whether or not the phase includes the above-mentioned features by observing at least three regions having a size of 40 μm×30 μm at a sheet thickness ¼ depth position from the surface of the steel sheet at a magnification of 1000 to 100000 times using a scanning electron microscope, and the confirmation of the presence positions, and the measurement of the area fractions are performed.

Area fraction of residual austenite: 3.0% or more

The residual austenite is a metallographic structure that is present as a face-centered cubic lattice even at room temperature. The residual austenite has an effect of increasing the ductility of the steel sheet due to transformation-induced plasticity (TRIP). When the area fraction of the residual austenite is less than 3.0%, the effect cannot be obtained and the ductility of the steel sheet is deteriorated. Therefore, the area fraction of the residual austenite is set to 3.0% or more. The area fraction of the residual austenite is preferably 5.0% or more, more preferably 7.0% or more, and even more preferably 8.0% or more. The upper limit of the area fraction of the residual austenite does not need to be particularly specified, but since the area fraction of the residual austenite that can be secured in the chemical composition of the hot-rolled steel sheet according to the embodiment is approximately 20.0% or less, the upper limit of the area fraction of the residual austenite may be set to 20.0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In this embodiment, the area fraction of the residual austenite is measured by X-ray diffraction.

In the measurement of the area fraction of the residual austenite by X-ray diffraction in the embodiment, first, the integrated intensities of 6 peaks of $\alpha(110)$, $\alpha(200)$, $\alpha(211)$, $\gamma(111)$, $\gamma(200)$, and $\gamma(220)$ are obtained in the cross section parallel to the rolling direction of the steel sheet at a sheet thickness ¼ depth position of the steel sheet using Co-Kα rays, and the volume fraction of the residual austenite is obtained by calculation using the intensity averaging method. Assuming that the volume fraction and the area fraction are equal, this is taken as the area fraction of residual austenite.

In the embodiment, the area fraction of the bainite, tempered martensite, ferrite, pearlite and martensite (the area fraction excluding the residual austenite) and the area fraction of the residual austenite are measured by different measurement methods. Thus, the total of the two area fractions may not be 100.0%. In a case where the total of the area fraction other than the residual austenite and the area fraction of the residual austenite is not 100.0%, the above two area fractions are adjusted so that the total becomes 100.0%. For example, in a case where the total of the area fraction excluding the residual austenite and the area fraction of the residual austenite is 101.0%, in order to make the total of the two area fractions 100.0%, a obtained by multiplying the area fraction excluding the residual austenite obtained by the measurement by 100.0/101.0 is defined as the area fraction excluding the residual austenite, and a value obtained by multiplying the area fraction of the residual austenite obtained by measurement by 100.0/101.0 is defined as the area fraction of the residual austenite.

In a case where the total of the area fraction excluding the residual austenite and the area fraction of the residual austenite is less than 95.0% or more than 105.0%, the area fractions are measured again.

Average grain size of metallographic structure excluding residual austenite: 7.0 μm or less When the average grain size (hereinafter, simply referred to as the average grain size in some cases) of the metallographic structure (bainite and tempered martensite as primary phases, ferrite, pearlite, and martensite) excluding the residual austenite is refined, the low temperature toughness is improved. When the average grain size is more than 7.0 μm, vTrs≤−50° C., which is an index of low temperature toughness required for steel sheets for suspension components of vehicles, cannot be satisfied. Therefore, the average grain size is set to 7.0 μm or less. The lower limit of the average grain size is not particularly limited, but the smaller the average grain size is, the more preferable it is, and the average grain size may be more than 0 μm. However, since it may be practically difficult to set the average grain size to less than 1.0 μm from the viewpoint of manufacturing equipment, the average grain size may be 1.0 μm or more.

In the embodiment, the crystal grains are defined by using the electron back scatter diffraction pattern-orientation image microscope (EBSP-OIM™) method. In the EBSP-OIM method, a crystal orientation of an irradiation point can be measured for a short time period in such manner that a highly inclined sample in a scanning electron microscope (SEM) is irradiated with electron beams, a Kikuchi pattern formed by back scattering is photographed by a high sensitive camera, and the photographed image is processed by a computer. The EBSP-OIM method is performed using a device in which a scanning electron microscope and an EBSP analyzer are combined and an OIM Analysis (registered trademark) manufactured by AMETEK Inc. In the EBSP-OIM method, the fine structure and crystal orientation of the sample surface can be quantitatively analyzed. The analyzable area of the EBSP-OIM method is a region that can be observed by the SEM. The EBSP method makes it possible to analyze a region with a minimum resolution of 20 nm, which varies depending on the resolution of the SEM. Since the threshold value of the high-angle grain boundary generally recognized as a grain boundary is 15°, in the embodiment, from a mapping image in which a crystal grain with an orientation difference of adjacent crystal grains of 15° or more is defined as one crystal grain, crystal grains are visualized, from which the average grain size of the area average calculated by the OIM Analysis is obtained.

When measuring the average grain size of the metallographic structure at the sheet thickness ¼ depth position from the surface of the steel sheet in the cross section parallel to the rolling direction of the steel sheet, the grain size is measured in at least 10 visual fields of a region of 40 μm×30 μm at a magnification of 1200 times, and the average of crystal grain sizes (effective grain sizes) with an orientation difference of adjacent crystal grains of 15° or more is used as the average grain size. In this measurement method, since the area fraction of structures other than the primary phases is small, it is determined that the effect is small, and the average grain size of the bainite and the tempered martensite, which are the primary phases, and the average grain size of the ferrite, the pearlite, and the martensite are not distinguished. That is, the average grain size measured by the above-mentioned measurement method are the average grain size of the bainite, the tempered martensite, the ferrite, the pearlite, and the martensite. In the measurement of the effective grain size of the pearlite, the effective grain size of the ferrite in the pearlite is measured instead of the effective grain size of the pearlite block.

Since the crystal structure of the residual austenite is FCC and the other microstructures are BCC, which are different from each other, the average grain size of the metallographic structure excluding the residual austenite can be easily measured by EBSP.

Average number density of iron-based carbides with diameter of 20 nm or more: $1.0\times10^6$ carbides/mm$^2$ or more The reason why iron-based carbides having a diameter of 20 nm or more are contained in the steel at a density of $1.0\times10^6$ carbides/mm$^2$ or more is to enhance the low temperature toughness of the primary phase and to obtain a balance between excellent strength and low temperature toughness. The iron-based carbide in the embodiment means one containing Fe and C and having a major axis length of less than 1 μm. That is, coarse carbides precipitated between cementite and bainite lath in pearlite having a major axis length of 1 μm or more are not included in this embodiment. When the primary phase is as-quenched martensite, the strength is excellent but the low temperature toughness is poor. Thus, it is necessary to improve the low temperature toughness. Therefore, by precipitating a predetermined number or more of iron-based carbides in the steel by tempering or the like, the low temperature toughness of the primary phase is improved, and the low temperature toughness (vTrs≤−50° C.) required for steel sheets for suspension components of vehicles is achieved.

As a result of investigating the relationship between low temperature toughness of the steel sheet and the number density of iron-based carbides, the present inventors have found that by setting the number density of iron-based carbides in the metallographic structure to $1.0\times10^6$ carbides/mm$^2$ or more, particularly, setting the number density of iron-based carbides in the tempered martensite and the lower bainite to $1.0\times10^6$ carbides/mm$^2$ or more, excellent low temperature toughness can be secured. Therefore, in the embodiment, the number density of iron-based carbides is set to $1.0\times10^6$ carbides/mm$^2$ or more in the metallographic structure at the sheet thickness ¼ depth position from the surface of the steel sheet in the cross section parallel to the rolling direction of the steel sheet. The number density of iron-based carbides is preferably $5.0\times10^6$ carbides/mm$^2$ or more and more preferably $1.0\times10^7$ carbides/mm$^2$ or more.

In addition, it is assumed that since the size of the iron-based carbides precipitated in the hot-rolled steel sheet according to the embodiment is as small as 300 nm or less, and most of the iron-based carbides are precipitated in the lath of martensite or bainite, the low temperature toughness is not deteriorated.

The number density of iron-based carbides is measured by collecting a sample with the cross section parallel to the rolling direction of the steel sheet as a section to be observed, polishing and nital-etching the section to be observed, and observing a range of ⅛ sheet thickness to ⅜ sheet thickness with the sheet thickness ¼ depth position from the surface of the steel sheet being the center using a field emission scanning electron microscope (FE-SEM). 10 or more visual fields are observed at a magnification of 200000 times, and the number density of iron-based carbides having a diameter of 20 nm or more is measured.

Average Ni concentration on surface: 7.0% or more

In order to obtain excellent chemical convertibility and coating film adhesion of the zirconium-based chemical conversion film even on the surface of the ultrahigh-strength steel sheet after pickling (before a chemical conversion treatment), it is preferable that the amount of oxides of Si, Al, and the like on the surface of the pickled sheet is reduced to a harmless level. In order to obtain the above effect only by controlling the oxides of Si, Al, and the like, it is necessary to set a substantially non-oxidizing atmosphere using an inert gas such as Ar, He, or N2 or to cause incomplete combustion with an air ratio of less than 0.9, in a preheating zone of a heating furnace to suppress oxidation of the slab surface as much as possible in a heating step of hot rolling. However, in a case where low cost and mass production are assumed in a step of manufacturing a general hot-rolled steel sheet, it is not possible to set a substantially non-oxidizing atmosphere using an inert gas in the heating step of hot rolling. In addition, even when the air ratio is set to less than 0.9 to control the oxides of Si, Al, and the like, heat loss due to incomplete combustion increases and the thermal efficiency of the heating furnace itself decreases and thus, there is a problem such as an increase in manufacturing cost.

The present inventors have conducted an investigation on coating film adhesion after a chemical conversion treatment using a zirconium-based chemical conversion treatment liquid in the ultrahigh-strength steel sheet having the above-described chemical composition and structure, a tensile strength of 980 MPa or more, and excellent ductility and stretch flangeability on the assumption of the application of a manufacturing step that is inexpensive and capable of mass production. Since the hot-rolled steel sheet is usually subjected to a chemical conversion treatment after pickling, the steel sheet after pickling is evaluated in the embodiment as well. In the embodiment, pickling is carried out using a 1 to 10 mass % hydrochloric acid solution at a temperature of 20° C. to 95° C. under the condition of a pickling time of 30 seconds or more and less than 60 seconds. In a case where no scale is formed on the surface, evaluation may be performed without pickling.

As a result of the investigation, it has been found that in the measurement using FE-EPMA, in a case where the average Ni concentration on the surface is 7.0% or more in terms of mass %, even when the oxides of Si, Al, and the like remain on the surface of the pickled sheet, the coating peeling width in all the samples evaluated by the method described later is within 4.0 mm as a reference, and the coating film adhesion is excellent. In addition, in such a case, no lack of hiding is observed in the chemical conversion film. On the other hand, the coating peeling width is more than 4.0 mm in all the samples having an average Ni concentration of less than 7.0% on the surface.

Figure 2:
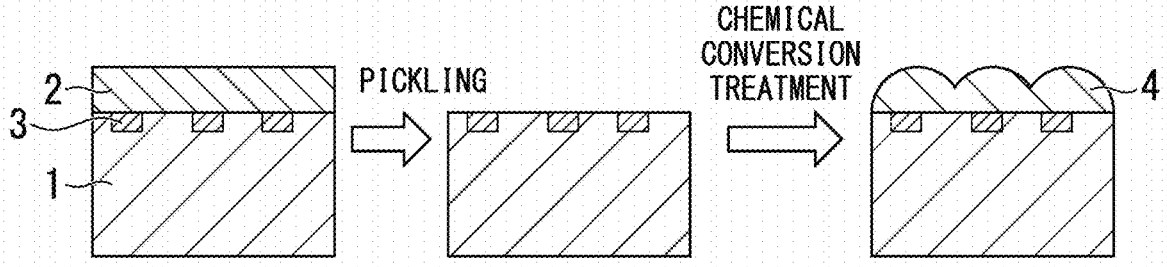
FIG. 2 is a diagram showing a mechanism in which Ni concentrated on the surface becomes a precipitation nucleus of a zirconium-based chemical conversion crystal.

It is considered that this is because, as shown in FIG. 2, by forming a Ni concentrated portion 3 on the surface of the steel sheet, a potential difference is generated between the locally concentrated Ni on the surface and a base metal 1, and this Ni becomes a precipitation nucleus of a zirconium-based chemical conversion crystal, so that the formation of the zirconium-based chemical conversion crystal 4 is promoted. The base metal 1 refers to the steel sheet portion excluding scale 2.

Therefore, in the hot-rolled steel sheet according to the embodiment, the average Ni concentration on the surface (the surface after pickling and before a chemical conversion treatment) is 7.0% or more. In a case where the average Ni concentration on the surface is 7.0% or more, even when the oxides of Si, Al, and the like remain on the surface, it is sufficient to form a precipitation nucleus of a zirconium-based chemical conversion crystal. In order to set the average Ni concentration on the surface to 7.0% or more, it is necessary to concentrate Ni, which is less likely to be oxidized than Fe on the base metal side of the interface between scale and the base metal by selectively oxidizing Fe to some extent on the surface of the steel sheet in the heating step of hot rolling.

The average Ni concentration on the surface of the steel sheet is measured using a JXA-8530F field emission electron probe microanalyzer (FE-EPMA). The measurement conditions are an acceleration voltage of 15 kV, an irradiation current of $6\times10^{-8}$ A, an irradiation time of 30 ms, and a beam diameter of 1 μm. The measurement is performed on a measurement area of 900 μm$^2$ or more from a direction perpendicular to the surface of the steel sheet, and the Ni concentration in the measurement range is averaged (the Ni concentration at all measurement points is averaged).

FIG. 1 shows an example of the EPMA measurement results of the surface.

Ni is mainly concentrated on the base metal side of the interface between scale and the base metal. In addition, pickling is usually performed before a chemical conversion treatment is performed. Therefore, in a case where scale is formed on the surface of the target steel sheet, the measurement is performed after pickling in the same manner as in a case where the steel sheet is subjected to a chemical conversion treatment.

The coating film adhesion of the pickled sheet described above is evaluated according to the following procedure. First, a manufactured steel sheet is pickled and then subjected to a chemical conversion treatment to adhere a zirconium-based chemical conversion film. Further, electrodeposition coating with a thickness of 25 μm is performed on the upper surface thereof, and a coating baking treatment is performed at 170° C. for 20 minutes. Then, the electrodeposition coating film is cut to a length of 130 mm using a knife having a sharp tip end so that the cut portion reaches the base metal. Then, 5% salt water is continuously sprayed at a temperature of 35° C. for 700 hours under the salt spray conditions shown in JIS Z 2371: 2015, and then a tape having a width of 24 mm (NICHIBAN 405A-24, JIS Z 1522: 2009) is attached in parallel with the cut portion with a length of 130 mm and peeled off. Then, the maximum coating film peeling width is measured.

The hot-rolled steel sheet has an internal oxide layer (a region in which oxides are formed inside the base metal), and the average depth of the internal oxide layer from the surface of the hot-rolled steel sheet is 5.0 μm or more and 20.0 μm or less.

Even in a case where there is a Ni concentrated portion on the surface layer, when the coverage of oxides of Si, Al, and the like is too large on the surface of the hot-rolled steel sheet, "lack of hiding" on which the zirconium-based chemical conversion film is not attached is likely to be generated. In order to suppress this phenomenon, it is desirable that the oxidation of Si, Al, and the like is carried out by not external oxidation for forming oxides on the outer side of the base metal but internal oxidation for forming oxides on the inner side of the base metal.

The present inventors have observed the cross section of only a sample having an average Ni concentration of 7.0% or more on the surface with an optical microscope and have examined the relationship between the coating peeling width and the average depth of the internal oxide layers from the surface of the steel sheet (the average of the positions of the lower ends of the internal oxide layers). As a result, it has been found that while all the samples in which the average depth of the internal oxide layer is 5.0 μm or more have a coating peeling width of 3.5 mm or less, all the samples in which the average depth of the internal oxide layer is less than 5.0 μm have a coating peeling width of more than 3.5 mm and 4.0 mm or less.

Therefore, in a case of obtaining more excellent coating film adhesion, the average depth of the internal oxide layer from the surface of the hot-rolled steel sheet is preferably 5.0 μm or more and 20.0 μm or less.

When the average depth of the internal oxide layer of Si, Al, or the like is less than 5.0 μm, the effect of suppressing "lack of hiding" on which the zirconium-based chemical conversion film is not attached is small. On the other hand, when the average depth is more than 20.0 μm, there is a concern that not only the effect of suppressing "lack of hiding" on which the zirconium-based chemical conversion film may be not attached is saturated, but also the hardness of the surface layer may be decreased due to the formation of a decarburized layer that occurs at the same time as internal oxidation, resulting in deterioration in fatigue durability.

The average depth of the internal oxide layer is obtained by cutting out a surface parallel with the rolling direction and the sheet thickness direction as an embedding sample at a ¼ or ¾ position in the sheet width direction of the pickled sheet, mirror-polishing the surface after embedding the steel sheet in the resin sample, and observing 12 or more visual fields with an optical microscope in a visual field of 195 μm×240 μm (corresponding to a magnification of 400 times) without etching. A position that intersects the surface of the steel sheet in a case where a straight line is drawn in the sheet thickness direction is set to a surface, the depth (position of the lower end) of the internal oxide layer in each visual field with the surface as a reference is measured and averaged at 5 points per visual field, the average value is calculated while excluding the maximum value and the minimum value from the average values of each visual field, and this calculated value is used as the average depth of the internal oxide layer.

Standard deviation of arithmetic average roughness Ra of surface of hot-rolled steel sheet after pickling under predetermined conditions: 10.0 μm or more and 50.0 μm or less The zirconium-based chemical conversion film has a very thin film thickness of about several tens of nm as compared with the conventional zinc phosphate film having a film thickness of several μm. This difference in film thickness is due to the fact that the zirconium-based chemical conversion crystals are extremely fine. When the chemical conversion crystal is fine, the surface of the chemical conversion crystal is very smooth. Thus, it is difficult to obtain a strong adhesion to the coating film due to the anchor effect as seen in the zinc phosphate-treated film.

However, as a result of the investigation by the present inventors, it has been found that the adhesion between the chemical conversion film and the coating film can be improved by forming irregularities on the surface of the steel sheet.

Based on the finding, regarding samples having an average Ni concentration of 7.0% or more and an internal oxide layer having an average depth of 5.0 μm or more, the present inventors have examined the relationship between the standard deviation of the arithmetic average roughness Ra of the surface of the pickled sheet before the zirconium-based chemical conversion treatment is performed and the coating film adhesion. As a result, all the samples in which the standard deviation of the arithmetic average roughness Ra of the surface of the pickled sheet is 10.0 μm or more and 50.0 μm or less have a coating peeling width of 3.0 mm or less. In contrast, all the samples in which the standard deviation of the arithmetic average roughness Ra of the surface of the pickled sheet is less than 10.0 μm or more than 50.0 μm have a coating peeling width of more than 3.0 mm and 3.5 mm or less.

Therefore, it is preferable that the standard deviation of the arithmetic average roughness Ra of the surface of the steel sheet after pickling is 10.0 μm or more and 50.0 μm or less.

When the standard deviation of the arithmetic average roughness Ra of the steel sheet surface is less than 10.0 μm, a sufficient anchor effect cannot be obtained. On the other hand, when the standard deviation of the arithmetic average roughness Ra of the steel sheet surface after pickling is more than 50.0 μm, not only the anchor effect is saturated, but also the zirconium-based chemical conversion crystals are less likely to be attached to the side surfaces of the valleys and mountain portions of the irregularities of the steel sheet surface after pickling. Thus, "lack of hiding" are more likely to be generated.

The surface roughness of the steel sheet greatly varies depending on the pickling conditions, but it is preferable that after the hot-rolled steel sheet according to the embodiment is pickled using a 1 to 10 mass % hydrochloric acid solution at a temperature of 20° C. to 95° C. under the condition of a pickling time of 30 seconds or more and less than 60 seconds, the standard deviation of the arithmetic average roughness Ra of the surface of the hot-rolled steel sheet is 10.0 μm or more and 50.0 μm or less.

For the standard deviation of the arithmetic average roughness Ra, a value obtained by measuring the surface roughness of the pickled sheet by the measurement method described in JIS B 0601: 2013 is adopted. After measuring the arithmetic average roughness Ra of the front and back surfaces of each of 12 or more samples, the standard deviation of the arithmetic average roughness Ra of each sample is calculated, and the maximum value and the minimum value are excluded from the standard deviations to calculate the average value.

The thickness of the hot-rolled steel sheet according to the embodiment is not particularly limited and may be 0.8 to 8.0 mm. When the sheet thickness of the steel sheet is less than 0.8 mm, it may be difficult to secure the rolling completion temperature and the rolling force may become excessive, making hot rolling difficult. Therefore, the sheet thickness of the steel sheet according to the present invention may be 0.8 mm or more. The sheet thickness is more preferably 1.2 mm or more and even more preferably 1.4 mm or more. On the other hand, when the sheet thickness is more than 8.0 mm, it may be difficult to refine the metallographic structure, and it may be difficult to secure the steel structure described above. Therefore, the sheet thickness may be 8.0 mm or less. More preferably, the sheet thickness is 6.0 mm or less.

The hot-rolled steel sheet according to the embodiment having the above-described chemical composition and metallographic structure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. The plating adhesion amount is not particularly limited and may be the same as before. Further, it is also possible to further enhance the corrosion resistance by applying an appropriate chemical conversion treatment (for example, application and drying of a silicate-based chromium-free chemical conversion treatment liquid) after plating.

[Manufacturing Method]

The hot-rolled steel sheet according to the embodiment having the above-mentioned chemical composition and metallographic structure can be manufactured by the following manufacturing method.

In order to obtain the hot-rolled steel sheet according to the embodiment, it is important that after performing heating and hot rolling under predetermined conditions, accelerated cooling is performed to a predetermined temperature range, and after coiling, the cooling history of the outermost circumferential portion of the coil and the inside of the coil is controlled. It is also important to control the air ratio in the heating furnace during slab heating before hot rolling.

In the method for manufacturing a hot-rolled steel sheet according to the embodiment, the following steps (I) to (VI) are sequentially performed. The temperature of the slab and the temperature of the steel sheet in the embodiment refer to the surface temperature of the slab and the surface temperature of the steel sheet.

(I) A slab is heated to 1150° C. or higher.

(II) Hot rolling is performed so that the cumulative rolling reduction is 90% or more in total in a temperature range of 850° C. to 1100° C. and the finish temperature is T2 (° C.), which is represented by Expression (2), or higher.

(III) Cooling is started within 1.5 seconds after the completion of hot rolling, and accelerated cooling is performed to a temperature T3 (° C.), which is represented by Expression (3), or lower at an average cooling rate of 50° C./sec or higher.

(IV) Cooling from the cooling stop temperature of the accelerated cooling to the coiling temperature is performed at an average cooling rate of 10° C./sec or higher.

(V) Coiling is performed at (T4−100)° C. to (T4+50)° C. with respect to the temperature T4 (° C.) which is represented by Expression (4).

$$T2(^\circ\,C.)=868-396\times[C]-68.1\times[Mn]+24.6\times[Si]-36.1\times[Ni]-24.8\times[Cr]-20.7\times[Cu]+250\times[Al] \quad (2)$$

$$T3(^\circ\,C.)=770-270\times[C]-90\times[Mn]-37\times[Ni]-70\times[Cr]-83\times[Mo] \quad (3)$$

$$T4(^\circ\,C.)=591-474\times[C]-33\times[Mn]-17\times[Ni]-17\times[Cr]-21\times[Mo] \quad (4)$$

However, the [element symbol] in each expression indicates the amount (mass %) of each element in the slab.

The amount of each element in the slab is obtained by using a spark discharge emission spectrochemical analysis method (Quantovac, QV) on a sample taken from a molten steel.

[Heating Step]

As the slab (steel piece) to be provided to hot rolling, a slab obtained by continuous casting, a slab obtained by casting/blooming, and the like can be used, and slabs subjected to hot working or cold working as necessary can be used.

The temperature (slab heating temperature) of the slab used for hot rolling is set to 1150° C. or higher from the viewpoint of Ni concentration on the slab surface, an increase in rolling load during hot rolling, and material deterioration due to an insufficient cumulative rolling reduction inside the slab due to the increase in rolling load. From the viewpoint of suppressing scale loss, the slab heating temperature is preferably 1350° C. or lower. In a case where the slab to be provided to hot rolling is a slab obtained by continuous casting or a slab obtained by blooming and is in a high temperature state (1150° C. or higher), the slab may be directly subjected to hot rolling without heating.

However, in order to obtain excellent coating film adhesion, it is important to control the air ratio of each zone of the heating furnace in slab heating as follows. In order to control the air ratio in each zone, it is preferable that the burner equipment of the heating furnace is a regenerative burner. This is because, since the soaking properties of the temperature inside the furnace are high, the controllability of each zone is high, and particularly, the air ratio in each zone can be strictly controlled in the regenerative burner compared to the conventional burner, the heating furnace described later can be controlled.

The preferable air ratio of each zone will be described.

<Air Ratio In Preheating Zone:1.1 to 1.9>

By setting the air ratio in the preheating zone to 1.1 or more, Ni can be concentrated on the surface of the hot-rolled steel sheet after pickling, and the average Ni concentration can be set to 7.0% or more.

The scale growth behavior of the slab surface in the heating furnace is classified into a linear rate law in which oxygen supply rate from the atmosphere on the slab surface is rate-controlling, and a parabolic rate law in which iron ion diffusion rate control in the scale is rate-controlling based on the air ratio (oxygen partial pressure) when evaluated by the generated scale thickness. In order to promote the growth of the scale of the slab to some extent and form a sufficient Ni concentrated layer on the surface layer in the limited in-furnace time in the heating furnace, the growth of the scale thickness needs to follow the parabolic rate law.

When the air ratio in the preheating zone is less than 1.1, the scale growth does not follow the parabolic rate law and a sufficient Ni concentrated layer cannot be formed on the surface layer of the slab in the limited in-furnace time in the heating furnace. In this case, the average Ni concentration on the surface of the hot-rolled steel sheet after pickling is not 7.0% or more, and good coating film adhesion cannot be obtained.

On the other hand, when the air ratio in the preheating zone is more than 1.9, the scale-off amount increases and the yield is deteriorated, and the heat loss due to an increase in exhaust gas also increases. Thus, the thermal efficiency is deteriorated and the manufacturing cost is increased.

The amount of scale formed in the heating furnace is dominated by the atmosphere of the preheating zone immediately after insertion of the heating furnace, and even when the atmosphere of the subsequent zone is changed, the scale thickness is hardly affected. Accordingly, it is very important to control the scale growth behavior in the preheating zone.

<Air Ratio In Heating Zone:0.9 to 1.3>

In order to form the internal oxide layer, it is necessary to control the air ratio in the heating zone in the heating step. By setting the air ratio in the heating zone to 0.9 or more and 1.3 or less, the average depth of the internal oxide layer can be set to 5.0 to 20.0 μm.

When the air ratio in the heating zone is less than 0.9, the average depth of the internal oxide layer is not 5.0 μm or more. On the other hand, when the air ratio in the heating zone is more than 1.3, there is a concern that not only the average depth of the internal oxide layer may be more than 20.0 μm, but also the hardness of the surface layer may be decreased due to the formation of a decarburized layer, resulting in deterioration in fatigue durability.

<Air Ratio In Soaking Zone:0.9 to 1.9>

Figure 3:
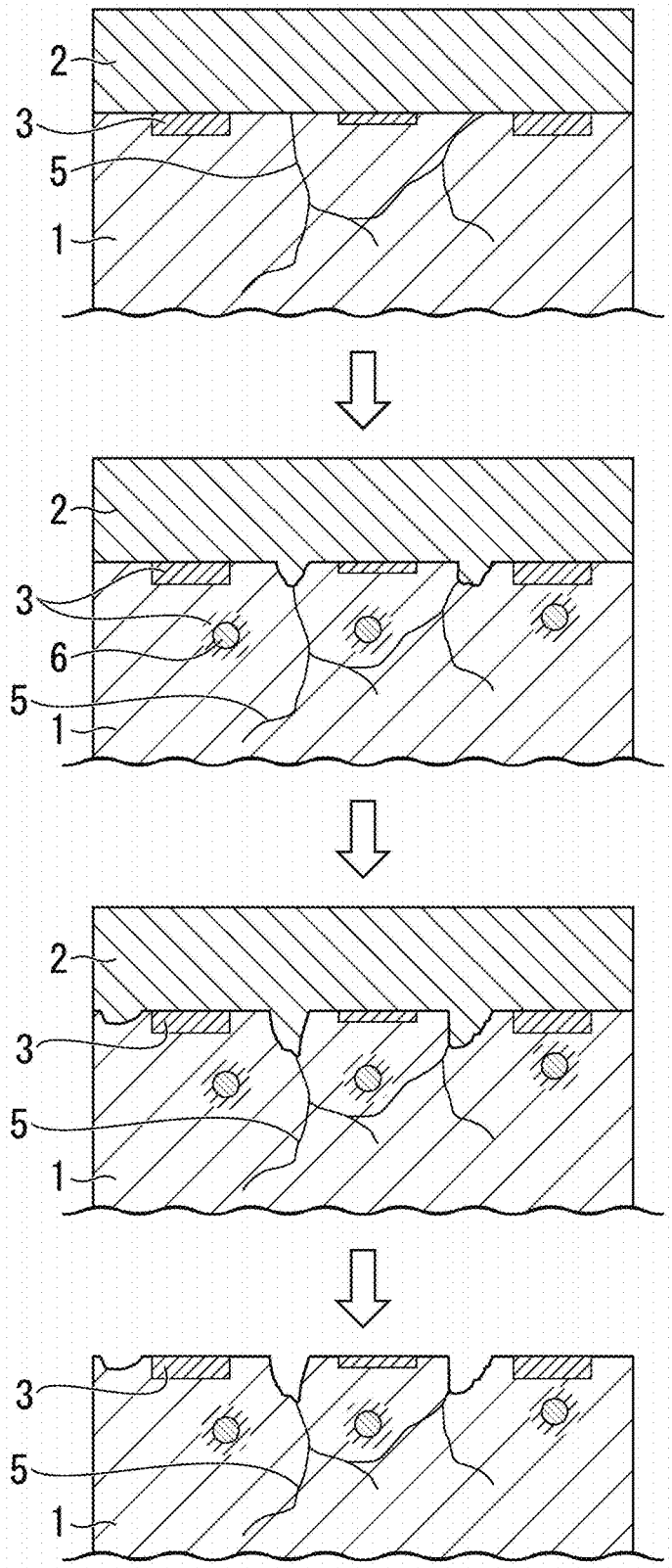
FIG. 3 is a diagram showing a mechanism in which the surface roughness of the hot-rolled steel sheet is changed.

In order to control the irregularities of the surface of the steel sheet after pickling, it is effective to control the air ratio in the soaking zone which is a zone immediately before extraction in the heating step. In the preheating zone, Ni, which is less likely to be oxidized than Fe, is concentrated on the base metal side at the interface between the scale and the base metal. While oxidation in the surface layer is suppressed by the Ni concentrated layer having the Ni concentrated portion, external oxidation is suppressed in the subsequent heating zone and internal oxidation is promoted. Thereafter, by controlling the air ratio in the soaking zone, for example, as shown in FIG. 3, grain boundaries 5 and the like where diffusion is easy are eroded by the scale 2, or the state of oxidation of the interface between the scale 2 and the base metal 1 due to a difference in the Ni concentration on the surface of the base metal 1 caused by a difference in the degree of Ni concentration degree becomes ununiform. Thus, the irregularities at the interface between the scale 2 and the base metal 1 become larger. In addition, although not shown in FIG. 3, irregularities are also generated by suppressing the erosion of the grain boundaries due to the scale 2 by the Ni concentrated portion 3 around an internal oxide 6. When this steel sheet is pickled, the scale 2 is removed, and the surface of the hot-rolled steel sheet has a predetermined roughness.

By setting the air ratio in the soaking zone to 0.9 or more and 1.9 or less, after the hot rolling, for example, pickling is performed using a 1 to 10 mass % hydrochloric acid solution at a temperature of 20° C. to 95° C. under the condition of a pickling time of 30 seconds or more and less than 60 seconds, the standard deviation of the arithmetic average roughness Ra of the surface of the hot-rolled steel sheet can be set to 10.0 μm or more and 50.0 μm or less.

When the air ratio in the soaking zone is less than 0.9, the oxygen potential for selectively forming oxide nuclei at the grain boundaries where diffusion is easy is not attained. Therefore, the standard deviation of the arithmetic average roughness Ra of the surface of the steel sheet after the pickling is not 10.0 μm or more. On the other hand, when the air ratio in the soaking zone is more than 1.9, the depth of the selectively oxidized grain boundaries in the sheet thickness direction becomes too deep, and the standard deviation of the arithmetic average roughness Ra of the steel sheet surface after the pickling is more than 50.0 μm.

Air Ratio In Preheating Zone>Air Ratio In Heating Zone

It is important to control the air ratio in the preheating zone to control the Ni concentration on the surface of the hot-rolled steel sheet after the pickling. On the other hand, it is important to control the air ratio in the heating zone to control the degree of formation of the internal oxide layer. Therefore, it is necessary to promote the growth of the scale of the slab to some extent in the preheating zone in the limited in-furnace time to form a sufficient Ni concentrated layer on the surface layer. For that purpose, a relatively high air ratio is required in which the growth of the scale thickness follows the parabolic rate law. On the other hand, in order to control the average depth of the internal oxide layer within a preferable range, it is necessary to suppress the air ratio to be relatively low in the heating zone and suppress the rapid growth of the internal oxide layer. In addition, when the air ratio is high in the heating zone, there is a concern that a decarburized layer may be formed and grown, the hardness of the surface layer may be decreased, and thus the fatigue durability may be deteriorated. Therefore, it is preferable that the air ratio in the preheating zone is higher than the air ratio in the heating zone.

[Hot Rolling Step]

In hot rolling, it is preferable to use a reverse mill or a tandem mill for multi-pass rolling. Particularly, from the viewpoint of industrial productivity, it is more preferable that at least the final several stages are hot-rolled using a tandem mill.

Hot rolling reduction: cumulative rolling reduction (sheet thickness reduction) of 90% or more in total in temperature range of 850° C. to 1100° C.

By performing hot rolling so that the cumulative rolling reduction is 90% or more in total in the temperature range of 850° C. to 1100° C., recrystallized austenite grains are mainly refined, accumulation of strain energy in unrecrystallized austenite grains is promoted, and thus the average grain size of the bainite and the tempered martensite, which are the primary phases, becomes finer. Accordingly, hot rolling is performed so that the cumulative rolling reduction is 90% or more in total (the sheet thickness reduction by rolling is 90% or more) in the temperature range of 850° C. to 1100° C. The cumulative rolling reduction in the temperature range of 850° C. to 1100° C. refers to a percentage of the difference between the inlet sheet thickness before the first pass in rolling in this temperature range and the outlet sheet thickness after the final pass in rolling in this temperature range.

Hot rolling completion temperature (finish temperature): T2 (° C.) or higher

The completion temperature of hot rolling is T2 (° C.) or higher. By setting the hot rolling completion temperature to T2 (° C.) or higher, excessive growth of ferrite nucleation sites in the austenite can be suppressed, and the area fraction of the ferrite in the final structure (the metallographic structure of the hot-rolled steel sheet after manufacturing) can be suppressed to less than 5.0%.

[Primary Cooling Step]

Accelerated cooling after completion of hot rolling: starting cooling within 1.5 seconds and performing cooling to T3 (° C.) or less at an average cooling rate of 50° C./sec or higher In order to suppress the growth of austenite grains refined by hot rolling, accelerated cooling is started within 1.5 seconds after the completion of hot rolling.

By starting the accelerated cooling is started within 1.5 seconds after the completion of hot rolling (primary cooling) and performing cooling to T3 (° C.) or less at an average cooling rate of 50° C./sec or higher, the formation of ferrite and pearlite is suppressed, and thus the area fraction of the bainite and the tempered martensite can be increased. Thus, the uniformity in the metallographic structure is improved, and the strength and stretch flangeability of the steel sheet are improved. The average cooling rate referred herein is a value obtained by dividing the temperature drop width of the steel sheet from the start of accelerated cooling (when the steel sheet is introduced into cooling equipment) to the completion of accelerated cooling (when the steel plate is taken out from the cooling equipment) by the time required from the start of accelerated cooling to the completion of accelerated cooling. In the accelerated cooling after the completion of hot rolling, when the time to start cooling is longer than 1.5 seconds, the average cooling rate is lower than 50° C./sec, or the cooling stop temperature is more than T3 (° C.), the ferritic transformation and/or pearlitic transformation inside the steel sheet becomes remarkable, and it becomes difficult to obtain a metallographic structure including bainite and tempered martensite as primary phases. Therefore, in the accelerated cooling after the completion of hot rolling, cooling is started within 1.5 seconds after the completion of hot rolling, and cooling is performed to T3 (° C.) or lower at an average cooling rate of 50° C./sec or more. The upper limit of the cooling rate is not particularly specified, but when the cooling rate is increased, the cooling equipment becomes large and the equipment cost increases. Therefore, considering the equipment cost, the average cooling rate is preferably 300° C./sec or less. Further, the cooling stop temperature of accelerated cooling may be (T4−100)° C. or higher.

[Secondary Cooling Step]

Average cooling rate from cooling stop temperature of primary cooling to coiling temperature: 10° C./sec or higher In order to suppress the area fraction of the pearlite to less than 5.0%, the average cooling rate from the cooling stop temperature of the accelerated cooling to the coiling temperature is set to 10° C./sec or more (secondary cooling). Thereby, the area fraction of the bainite and the tempered martensite is increased, and the balance between the strength and stretch flangeability of the steel sheet can be improved. The average cooling rate referred here is a value obtained by dividing the temperature drop width of the steel sheet from the start of cooling stop temperature of the accelerated cooling to the coiling temperature by the time required from the stop of accelerated cooling to coiling. When the average cooling rate is lower than 10° C./sec, the area fraction of the pearlite is increased, the strength is decreased, and the ductility is decreased. Therefore, the average cooling rate from the cooling stop temperature of the accelerated cooling to the coiling temperature is set to 10° C./sec or higher. Although the upper limit is not particularly specified, the average cooling rate is preferably 300° C./sec or lower in consideration of the sheet warpage due to thermal strain.

[Coiling Step]

Coiling temperature: (T4−100)° C. to (T4+50)° C.

The coiling temperature is set to (T4−100)° C. to (T4+50)° C. When the coiling temperature is lower than (T4−100)° C., carbon emission from the bainite and the tempered martensite into the austenite does not proceed and the austenite is not stabilized. Therefore, it is difficult to obtain residual austenite having an area fraction of 3.0% or more, and the ductility of the steel sheet is decreased. In addition, the low temperature toughness of the steel sheet is also deteriorated due to a decrease in the number density of iron-based carbides. Further, in a case where the coiling temperature is higher than (T4+50)° C., carbon emitted from the bainite and the tempered martensite is excessively precipitated in the steel as iron-based carbides. Therefore, it is also disadvantageous that carbon is sufficiently concentrated in the austenite and the C concentration in the residual austenite is 0.50% by mass or more. Accordingly, the coiling temperature is set to (T4−100)° C. to (T4+50)° C.

After the coiling, cooling may be performed to room temperature by an ordinary method.

[Pickling Step]

[Skin Pass Step]

Skin pass rolling may be performed at a rolling reduction of 0.1% or more and 2.0% or less for the purpose of correcting the steel sheet shape and improving the ductility by introduction of moving dislocation. In addition, for the purpose of removing scale attached to the surface of the obtained hot-rolled steel sheet, pickling may be performed on the obtained hot-rolled steel sheet. In a case where pickling is performed, it is preferable to perform pickling using a 1 to 10 wt % hydrochloric acid solution at a temperature of 20° C. to 95° C. under the condition of a pickling time of 30 seconds or more and less than 60 seconds.

Further, it is also possible to perform skin pass or cold rolling at a rolling reduction of 10% or less inline or offline on the obtained hot-rolled steel sheet after the pickling.

According to the above manufacturing method, the hot-rolled steel sheet according to the embodiment can be manufactured.

EXAMPLES

Hereinafter, the present invention will be described in more detail with reference to examples, but the present invention is not limited to these examples.

Steels having the compositions shown in Steel Nos. A to W in Tables 1A and 1B were melted and subjected to continuous casting to manufacture slabs having a thickness of 240 to 300 mm. The obtained slabs were heated to the temperatures shown in Tables 2A and 2B using a regenerative burner. At that time, the air ratios in the preheating zone, the heating zone, and the soaking zone were controlled as shown in Tables 2A and 2B.

The heated slabs were hot-rolled at the cumulative rolling reductions and the finish temperatures shown in Tables 2A and 2B. After the hot rolling, cooling was performed at the timing under the cooling conditions shown in Tables 2A and 2B, and after the cooling, coiling was performed.

The steels of Nos. 2 and 8 were hot-dip galvanized.

The metallographic structures of the obtained hot-rolled steel sheets of Manufacturing Nos. 1 to 38 were observed, and the area fraction of each phase and the average grain size were obtained.

The area fraction of each phase was obtained by the following method.

The cross section of the steel sheet parallel to the rolling direction was etched using a Nital reagent and the reagent disclosed in Japanese Unexamined Patent Application, First Publication No. S59-219473. Regarding the etching of the cross section, specifically, a solution prepared by dissolving 1 to 5 g of picric acid in 100 ml of ethanol was used as solution A, and a solution prepared by dissolving 1 to 25 g of sodium thiosulfate and 1 to 5 g of citric acid in 100 ml of water was used as a solution B. A liquid mixture in which the solution A and the solution B are mixed at a ratio of 1:1 was prepared and a liquid prepared by adding and mixing nitric acid at a ratio of 1.5% to 4% with respect to the total amount of the liquid mixture was used as a pretreatment liquid. In addition, a liquid prepared by adding and mixing the pretreatment liquid into a 2% Nital solution at a ratio of 10% with respect to the total amount of the 2% Nital solution is used as a post treatment liquid. The cross section of the steel sheet parallel to the rolling direction was immersed in the pretreatment liquid for 3 to 15 seconds, washed with alcohol, and dried. Then, the cross section was immersed in the post treatment liquid for 3 to 20 seconds, then washed with water, and dried to corrode the cross section.

Next, by observing at least three regions having a size of 40 μm×30 μm at a sheet thickness ¼ depth position from the surface of the steel sheet at a magnification of 1000 to 100000 times using a scanning electron microscope and a transmission electron microscope, the bainite, the tempered martensite, the ferrite, the pearlite, and the martensite in the metallographic structure were identified from the shape and the carbide state, and the confirmation of the presence positions thereof, and the measurement of the area fraction were performed.

In addition, the area fraction of the residual austenite was measured using X-ray diffraction. Specifically, first, the integrated intensities of 6 peaks of α(110), α(200), α(211), γ(111), γ(200), and γ(220) were obtained in the cross section parallel to the rolling direction of the steel sheet at a sheet thickness ¼ depth position of the steel sheet using Co-Kα rays, and the area fraction of the residual austenite was obtained by calculation using the intensity averaging method.

The average grain size was obtained by the following method.

The average grain size was obtained by defining a crystal grain with an orientation difference of adjacent crystal grains of 15° or more as one crystal grain using the electron back scatter diffraction pattern-orientation image microscope (EBSP-OIM), and visualizing the crystal grains from a mapping image. When measuring the average grain size of the metallographic structure at the sheet thickness ¼ depth position from the surface of the steel sheet in the cross section parallel to the rolling direction of the steel sheet, the grain size was measured in 10 visual fields of a region of 40 μm×30 μm at a magnification of 1200 times, and the average of crystal grain sizes (effective grain sizes) with an orientation difference of adjacent crystal grains of 15° or more was used as the average grain size.

In addition, the obtained hot-rolled steel sheet was pickled with a 1 to 10 mass % hydrochloric acid solution at a temperature of 20° C. to 95° C. under the condition of a pickling time of 30 seconds or more and less than 60 seconds, and then the Ni concentration on the surface, the number density of iron-based carbides, the average depth of the internal oxide layer, and the arithmetic average roughness of the surface were obtained.

The Ni concentration on the surface was obtained by the following method.

The Ni concentration in the target hot-rolled steel sheet was analyzed in a measurement area of 900 $\mu m^2$ or more from a direction perpendicular the surface of the steel sheet using a JXA-8530F field emission electron probe microanalyzer (FE-EPMA), and the Ni concentrations in the measurement range were averaged. At this time, the measurement conditions were an acceleration voltage of 15 kV, an irradiation current of $6\times10^{-8}$ A, an irradiation time of 30 ms, and a beam diameter of 1 μm.

The number density of iron-based carbides was obtained by the following method.

A sample was collected with the cross section parallel to the rolling direction of the steel sheet as the section to be observed, and the section to be observed was polished and nital-etched. Then, a range of ⅛ thickness to ⅜ thickness with a sheet thickness ¼ depth position from the surface of the steel sheet being the center was observed using a field emission scanning electron microscope (FE-SEM) at a magnification of 200000 times in 10 visual fields. The number density of the iron-based carbides was measured.

The average depth of the internal oxide layer was obtained by the following method.

A surface parallel with the rolling direction and the sheet thickness direction was cut out as an embedding sample at a ¼ or ¾ position in the sheet width direction of the pickled sheet, the surface was mirror-polished after embedding the steel sheet in the resin sample, and 12 visual fields were observed with an optical microscope in a visual field of 195 μm×240 μm (corresponding to a magnification of 400 times) without etching. A position intersecting the surface of the steel sheet in a case where a straight line was drawn in the sheet thickness direction was set to a surface, the depth (position of the lower end) of the internal oxide layer in each visual field with the surface as a reference was measured and averaged at 5 points per visual field, the average value was calculated while excluding the maximum value and the minimum value from the average values of each visual field, and this calculated value was used as the average depth of the internal oxide layer.

The standard deviation of the arithmetic average roughness of the surface was calculated by the following method.

The surface roughness of the pickled sheet was obtained by measuring the arithmetic average roughness Ra of the front and back surfaces of each of 12 samples by the measurement method described in JIS B 0601: 2013, then calculating the standard deviation of the arithmetic average roughness Ra of each sample, and excluding the maximum value and the minimum value from the standard deviations to calculate the average value.

In addition, the tensile strength, the toughness (vTrs), the ductility, and the stretch flangeability of the obtained steel sheets of Manufacturing Nos. 1 to 38 were obtained as mechanical properties.

The tensile strength and the ductility (total elongation) were obtained by collecting a JIS No. 5 test piece from the hot-rolled steel sheet and conducting a tensile test in accordance with JIS Z 2241: 2011. The tensile strength (TS) indicates the tensile strength of JIS Z 2241: 2011. The total elongation (t-EL) indicates the total elongation at the time of fracture of JIS Z 2241: 2011.

It was determined that preferable properties were obtained when the tensile strength was 980 MPa or more and the ductility was 12.0% or more.

The toughness was obtained by the following method. The transition temperature was obtained according to the Charpy impact test method for metal materials described in JIS Z 2242: 2005.

When vTrs was −50° C. or lower, it was determined that preferable properties were obtained.

For the stretch flangeability, the hole expansion value was obtained by the hole expansion test method described in JIS Z 2256: 2010, and this value was used as an index for stretch flangeability.

When the hole expansibility was 45% or more, it was determined that preferable properties were obtained.

In addition, the above-mentioned hot-rolled steel sheet after pickling was degreased, sufficiently washed with water, and immersed in a zirconium chemical conversion treatment bath. The chemical conversion treatment bath contained $(NH_4)_2ZrF_6$: 10 mM (mmol/l) and a metal salt of 0 to 3 mM, had a pH of 4 ($NH_3$, $HNO_3$), and had a bath temperature of 45° C. The treatment time was set to 120.

The chemical convertibility and coating film adhesion of the hot-rolled steel sheet after the chemical conversion treatment were evaluated.

The chemical convertibility was evaluated by the following method. The surface of the steel sheet after the chemical conversion treatment was observed with a field emission scanning electron microscope (FE-SEM). Specifically, 10 visual fields were observed at a magnification of 10000 times, and the presence or absence of "lack of hiding" on which the chemical conversion crystals were not attached was observed. The observation was performed at an acceleration voltage of 5 kV, a probe diameter of 30 mm, and inclination angles of 45° and 60°. Tungsten coating (ESC-101, Elionix) was applied for 150 seconds to impart conductivity to the sample.

In a case where no lack of hiding was observed in all the visual fields, it was determined that the chemical convertibility was excellent ("OK" in the tables).

The coating film adhesion was evaluated by the following method.

Electrodeposition coating with a thickness of 25 μm was performed to on upper surface of the hot-rolled steel sheet after the chemical conversion treatment, and a coating baking treatment was performed at 170° C. for 20 minutes. Then, the electrodeposition coating film was cut to a length of 130 mm using a knife having a sharp tip end so that the cut portion reached the base metal. Then, 5% salt water was continuously sprayed at a temperature of 35° C. for 700 hours under the salt spray conditions shown in JIS Z 2371, and then a tape having a width of 24 mm (NICHIBAN 405A-24, JIS Z 1522) was attached in parallel with the cut portion with a length of 130 mm and peeled off. Then, the maximum coating film peeling width was measured.

When the maximum coating film peeling width was 4.0 mm or less, it was determined that the coating film adhesion was excellent.

The results are shown in Tables 3A, 3B, and 3C.

As seen from Tables 3A, 3B, and 3C, in Manufacturing Nos. 1 to 4, 8 to 11, and 20 to 32 as Invention Examples, chemical conversion films having good chemical convertibility even when the chemical convertibility using a zirconium-based chemical conversion treatment liquid was performed and excellent coating film adhesion while securing mechanical properties required for steel sheets for vehicles even with a tensile strength of 980 MPa were obtained.

On the other hand, in Manufacturing Nos. 5 to 7, 12 to 19, and 33 to 38 in which the component, the metallographic structure, or the Ni concentration on the surface was not in the range of the present invention, the mechanical properties were not sufficient, the chemical convertibility and/or the coating film adhesion were deteriorated. (For reference, in Table 3C, the values outside the ranges of the present invention and the properties that did not reach the target are also underlined.)

TABLE 1A

| Steel | Mass % Remainder of Fe and impurities | | | | | | | | | | | | | | |
|---|---|---|---|---|---|---|---|---|---|---|---|---|---|---|---|
| No. | C | Si | Mn | Al | P | S | O | N | Ni | Nb | Ti | Cu | Mc | V | Cr |
| A | 0.114 | 1.01 | 2.90 | 0.041 | 0.006 | 0.0004 | 0.0064 | 0.0060 | 0.15 | | | | | | |
| B | 0.170 | 2.06 | 2.47 | 0.028 | 0.099 | 0.0018 | 0.0020 | 0.0039 | 0.02 | | | | | | |
| C | 0.239 | 2.28 | 1.02 | 0.065 | 0.089 | 0.0010 | 0.0084 | 0.0048 | 0.46 | | | | | | |
| D | 0.194 | 2.22 | 2.15 | 0.035 | 0.008 | 0.0040 | 0.0031 | 0.0038 | 0.03 | | | | | | |
| E | 0.245 | 2.68 | 1.51 | 0.040 | 0.040 | 0.0010 | 0.0094 | 0.0024 | 0.05 | | | | | | |
| F | 0.170 | 2.91 | 1.37 | 0.033 | 0.006 | 0.0015 | 0.0001 | 0.0050 | 0.67 | | | | | | |
| G | 0.134 | 0.39 | 3.90 | 0.558 | 0.091 | 0.0029 | 0.0050 | 0.0727 | 1.88 | | | | | | |
| H | 0.190 | 0.57 | 3.24 | 1.564 | 0.042 | 0.0040 | 0.0035 | 0.0031 | 1.59 | 0.025 | | | | | |
| I | 0.216 | 2.31 | 2.48 | 0.159 | 0.067 | 0.0038 | 0.0014 | 0.0797 | 1.09 | | 0.054 | | | | |
| J | 0.102 | 2.04 | 2.41 | 0.768 | 0.091 | 0.0027 | 0.0046 | 0.0861 | 1.41 | | | 0.05 | | | |
| K | 0.243 | 2.41 | 2.53 | 0.185 | 0.026 | 0.0047 | 0.0048 | 0.0770 | 0.72 | | | | 0.015 | | |
| L | 0.186 | 0.70 | 1.17 | 1.047 | 0.090 | 0.0004 | 0.0045 | 0.0483 | 0.15 | | | | | 0.499 | |
| M | 0.154 | 1.20 | 3.97 | 0.830 | 0.070 | 0.0028 | 0.0010 | 0.0849 | 0.23 | | | | | | 0.54 |
| N | 0.188 | 1.26 | 3.11 | 0.608 | 0.091 | 0.0009 | 0.0041 | 0.0419 | 0.16 | | | | | | |
| O | 0.194 | 1.83 | 3.81 | 0.695 | 0.000 | 0.0019 | 0.0029 | 0.0507 | 1.75 | | | | | | |
| P | 0.157 | 2.70 | 1.81 | 0.091 | 0.047 | 0.0009 | 0.0003 | 0.0495 | 1.23 | | | | | | |
| Q | 0.238 | 0.05 | 2.81 | 1.460 | 0.010 | 0.0036 | 0.0020 | 0.0033 | 0.04 | | | | | | |
| R | 0.088 | 0.54 | 3.36 | 0.597 | 0.062 | 0.0029 | 0.0028 | 0.0300 | 0.37 | | | | | | |
| S | 0.266 | 1.14 | 3.93 | 1.093 | 0.077 | 0.0042 | 0.0009 | 0.0314 | 0.08 | | | | | | |
| T | 0.115 | 2.88 | 1.28 | 0.037 | 0.081 | 0.0022 | 0.0045 | 0.0019 | 0.01 | | | | | | |
| U | 0.189 | 0.03 | 3.91 | 1.217 | 0.038 | 0.0048 | 0.0002 | 0.0478 | 0.58 | | | | | | |
| V | 0.229 | 1.73 | 0.94 | 0.997 | 0.023 | 0.0040 | 0.0036 | 0.0054 | 1.43 | | | | | | |
| W | 0.155 | 2.12 | 2.16 | 1.069 | 0.021 | 0.0017 | 0.0045 | 0.0133 | 0.74 | | | | | | |

TABLE 1B

| Steel | Mass % Remainder of Fe and impurities | | | | | | | | | | Si + Al | T2 | T3 | T4 |
|---|---|---|---|---|---|---|---|---|---|---|---|---|---|---|
| No. | Mg | Ca | REM | B | Bi | Zr | Co | Zn | W | Sn | (%) | (° C.) | (° C.) | (° C.) |
| A | | | | | | | | | | | 1.05 | 655 | 473 | 439 |
| B | | | | | 0.015 | | | | | | 2.09 | 689 | 501 | 429 |
| C | | | | | | | | | | | 2.34 | 759 | 597 | 436 |
| D | | | | | | | | | | | 2.26 | 707 | 523 | 428 |

TABLE 1B-continued

| Steel | Mass % Remainder of Fe and impurities | | | | | | | | | | Si + Al | T2 | T3 | T4 |
|---|---|---|---|---|---|---|---|---|---|---|---|---|---|---|
| No. | Mg | Ca | REM | B | Bi | Zr | Co | Zn | W | Sn | (%) | (° C.) | (° C.) | (° C.) |
| E | | | | | | | 0.67 | | | | 2.72 | 742 | 566 | 424 |
| F | | | | | | | | | | | 2.94 | 763 | 576 | 454 |
| G | | | | | | | | | | | 0.95 | 631 | 314 | 367 |
| H | | | | | | | | | | | 2.14 | 919 | 368 | 367 |
| I | | | | | | 0.32 | | | | | 2.47 | 671 | 448 | 388 |
| J | | | | | | | | | 0.51 | | 2.81 | 854 | 474 | 439 |
| K | | | | | | | | | | | 2.59 | 679 | 449 | 380 |
| L | | | | | | | | | | | 1.74 | 988 | 609 | 462 |
| M | | | | | | | | 0.67 | | | 2.03 | 752 | 325 | 374 |
| N | 0.0019 | | | | | | | | | | 1.87 | 759 | 434 | 397 |
| O | | 0.0015 | | | | | | | | | 2.52 | 688 | 310 | 344 |
| P | | | 0.0067 | | | | | | | 0.029 | 2.79 | 728 | 519 | 436 |
| Q | | | | 0.0016 | | | | | | | 1.51 | 947 | 451 | 385 |
| R | | | | | | | | | | | 1.14 | 754 | 431 | 432 |
| S | | | | | | | | | | | 2.23 | 793 | 341 | 334 |
| T | | | | | | | | | | | 2.92 | 815 | 623 | 494 |
| U | | | | | | | | | | | 1.24 | 811 | 346 | 362 |
| V | | | | | | | | | | | 2.72 | 954 | 571 | 427 |
| W | | | | | | | | | | | 3.19 | 952 | 506 | 434 |

TABLE 2A

| Manufacturing No. | Steel No. | Heating temperature ° C. | Pre-heating zone air ratio | Heating zone air ratio | Soaking zone air ratio | Cumulative rolling reduction at 850° C. to 1100° C. % | Finish rolling temperature ° C. | Time to start of cooling sec | Average cooling rate of primary cooling ° C./s | Primary cooling stop temperature ° C. | Average cooling rate of secondary cooling ° C./s | Coiling temperature ° C. | Remarks |
|---|---|---|---|---|---|---|---|---|---|---|---|---|---|
| 1 | A | 1260 | 1.5 | 1.0 | 1.5 | 91 | 800 | 1.2 | 170 | 450 | 40 | 400 | Invention Example |
| 2 | B | 1220 | 1.5 | 1.1 | 1.7 | 94 | 800 | 1.3 | 110 | 500 | 20 | 400 | Invention Example |
| 3 | C | 1260 | 1.2 | 1.0 | 1.4 | 91 | 800 | 0.4 | 280 | 550 | 20 | 400 | Invention Example |
| 4 | D | 1270 | 1.2 | 1.1 | 1.3 | 97 | 800 | 0.1 | 90 | 500 | 20 | 400 | Invention Example |
| 5 | D | 1120 | 1.3 | 1.1 | 1.4 | 96 | 800 | 1.3 | 110 | 500 | 40 | 400 | Comparative Example |
| 6 | D | 1230 | 2.0 | 0.9 | 1.3 | 92 | 800 | 0.3 | 50 | 500 | 40 | 400 | Comparative Example |
| 7 | D | 1260 | 0.9 | 1.1 | 1.7 | 94 | 800 | 0.9 | 290 | 500 | 30 | 400 | Comparative Example |
| 8 | D | 1270 | 1.3 | 1.5 | 1.7 | 92 | 800 | 0.2 | 120 | 500 | 20 | 400 | Invention Example |
| 9 | D | 1220 | 1.8 | 0.8 | 1.3 | 96 | 800 | 1.1 | 190 | 500 | 30 | 400 | Invention Example |
| 10 | D | 1220 | 1.3 | 0.9 | 2.0 | 97 | 800 | 0.8 | 220 | 500 | 40 | 400 | Invention Example |
| 11 | D | 1200 | 1.7 | 1.1 | 0.8 | 93 | 800 | 0.2 | 240 | 500 | 10 | 400 | Invention Example |
| 12 | D | 1270 | 1.5 | 1.3 | 1.9 | 87 | 800 | 1.4 | 140 | 500 | 30 | 400 | Comparative Example |
| 13 | D | 1260 | 1.9 | 0.9 | 1.0 | 90 | 700 | 0.7 | 180 | 500 | 40 | 400 | Comparative Example |
| 14 | D | 1280 | 1.4 | 0.9 | 1.7 | 95 | 800 | 1.7 | 120 | 500 | 30 | 400 | Comparative Example |
| 15 | D | 1210 | 1.3 | 1.1 | 1.8 | 95 | 800 | 1.3 | 35 | 500 | 40 | 400 | Comparative Example |
| 16 | D | 1280 | 1.2 | 1.0 | 1.2 | 94 | 800 | 0.8 | 60 | 575 | 20 | 400 | Comparative Example |
| 17 | D | 1200 | 1.7 | 1.2 | 1.9 | 94 | 800 | 1.2 | 170 | 500 | 5 | 400 | Comparative Example |
| 18 | D | 1220 | 1.8 | 1.0 | 1.8 | 92 | 800 | 0.1 | 300 | 500 | 40 | 500 | Comparative Example |

TABLE 2B

| Manufacturing No. | Steel No. | Heating temperature ° C. | Pre-heating zone air ratio | Heating zone air ratio | Soaking zone air ratio | Cumulative rolling reduction at 850° C. to 1100° C. % | Finish rolling temperature ° C. | Time to start of cooling sec | Average cooling rate of primary cooling ° C./s | Primary cooling stop temperature ° C. | Average cooling rate of secondary cooling ° C./s | Coiling temperature ° C. | Remarks |
|---|---|---|---|---|---|---|---|---|---|---|---|---|---|
| 19 | D | 1220 | 1.1 | 1.3 | 1.8 | 92 | 800 | 1.1 | 60 | 500 | 30 | 250 | Comparative Example |
| 20 | E | 1220 | 1.9 | 1.1 | 1.4 | 92 | 800 | 1.3 | 80 | 550 | 50 | 450 | Invention Example |
| 21 | F | 1230 | 1.4 | 1.0 | 1.3 | 96 | 800 | 1.2 | 160 | 550 | 20 | 450 | Invention Example |
| 22 | G | 1270 | 1.1 | 1.1 | 1.2 | 97 | 800 | 0.2 | 190 | 300 | 30 | 280 | Invention Example |
| 23 | H | 1250 | 1.5 | 1.0 | 1.5 | 94 | 950 | 1.0 | 210 | 350 | 40 | 300 | Invention Example |
| 24 | I | 1210 | 1.2 | 0.9 | 1.5 | 97 | 800 | 1.2 | 100 | 425 | 20 | 400 | Invention Example |
| 25 | J | 1200 | 1.4 | 0.9 | 1.3 | 94 | 900 | 0.8 | 140 | 450 | 40 | 400 | Invention Example |
| 26 | K | 1270 | 1.5 | 0.9 | 1.0 | 95 | 800 | 1.5 | 220 | 425 | 10 | 400 | Invention Example |
| 27 | L | 1250 | 1.2 | 1.1 | 1.4 | 90 | 1000 | 0.6 | 170 | 550 | 10 | 450 | Invention Example |
| 28 | M | 1260 | 1.7 | 1.1 | 1.2 | 97 | 800 | 1.1 | 110 | 300 | 10 | 290 | Invention Example |
| 29 | N | 1280 | 1.1 | 1.1 | 1.6 | 91 | 800 | 0.0 | 260 | 425 | 30 | 400 | Invention Example |
| 30 | O | 1230 | 1.2 | 1.1 | 1.5 | 93 | 800 | 1.1 | 60 | 300 | 10 | 280 | Invention Example |
| 31 | P | 1280 | 1.1 | 1.1 | 1.4 | 95 | 800 | 1.4 | 160 | 500 | 30 | 450 | Invention Example |
| 32 | Q | 1270 | 1.1 | 1.2 | 1.7 | 92 | 950 | 0.9 | 220 | 450 | 30 | 400 | Invention Example |
| 33 | R | 1260 | 1.7 | 0.9 | 1.4 | 93 | 800 | 1.1 | 210 | 425 | 20 | 400 | Comparative Example |
| 34 | S | 1250 | 1.5 | 1.1 | 1.2 | 91 | 800 | 1.0 | 100 | 300 | 30 | 280 | Comparative Example |
| 35 | T | 1220 | 1.3 | 0.9 | 1.1 | 92 | 850 | 1.1 | 220 | 550 | 50 | 450 | Comparative Example |
| 36 | U | 1260 | 1.5 | 1.3 | 1.5 | 93 | 850 | 0.6 | 160 | 300 | 30 | 280 | Comparative Example |
| 37 | V | 1230 | 1.1 | 1.3 | 1.4 | 97 | 980 | 0.6 | 90 | 550 | 40 | 450 | Comparative Example |
| 38 | W | 1230 | 1.7 | 1.2 | 1.2 | 96 | 980 | 0.6 | 180 | 500 | 30 | 450 | Comparative Example |

TABLE 3A

| Manufacturing No. | Metallographic structure | | | | | | Average number density of | Ni concentraton on surface mass % | Average depth of internal oxide layer μm | Arithmetic average roughness of surface μm | Sheet thickness mm |
|---|---|---|---|---|---|---|---|---|---|---|---|
| | Area % of tempered martensite + bainite | Area % of ferrite | Area % of pearlite | Area % of residual austenite | Area % of martensite | Average grain size μm | iron-based carbides ($\times 10^6$) carbides/mm$^2$ | | | | |
| 1 | 91.0 | 0.0 | 0.0 | 8.0 | 1.0 | 5.0 | 2.0 | 9.5 | 5.5 | 40.4 | 0.8 |
| 2 | 92.0 | 0.0 | 0.0 | 7.0 | 1.0 | 4.0 | 3.0 | 8.0 | 9.4 | 23.6 | 1.2 |
| 3 | 84.0 | 0.0 | 0.0 | 14.0 | 2.0 | 5.0 | 7.0 | 7.2 | 17.8 | 43.1 | 3.6 |
| 4 | 86.0 | 0.0 | 0.0 | 12.0 | 2.0 | 4.5 | 10.0 | 7.9 | 5.9 | 32.6 | 3.2 |
| 5 | 80.0 | 8.0 | 0.0 | 9.0 | 3.0 | 8.0 | 0.8 | 6.8 | 4.0 | 8.0 | 2.6 |
| 6 | 85.0 | 0.0 | 0.0 | 13.0 | 2.0 | 5.0 | 5.0 | 6.9 | 21.0 | 53.0 | 2.0 |
| 7 | 88.0 | 0.0 | 0.0 | 11.0 | 1.0 | 4.5 | 4.0 | 3.4 | 4.8 | 9.3 | 3.2 |
| 8 | 85.0 | 0.0 | 0.0 | 13.0 | 2.0 | 5.0 | 5.0 | 7.7 | 22.0 | 50.2 | 2.3 |
| 9 | 86.0 | 0.0 | 0.0 | 11.0 | 3.0 | 4.5 | 6.0 | 7.6 | 4.6 | 9.1 | 2.6 |
| 10 | 86.0 | 0.0 | 0.0 | 12.0 | 2.0 | 5.0 | 5.0 | 7.4 | 18.5 | 63.1 | 2.9 |
| 11 | 88.0 | 0.0 | 0.0 | 10.0 | 2.0 | 4.5 | 5.0 | 7.9 | 19.6 | 7.2 | 4.0 |
| 12 | 90.0 | 0.0 | 0.0 | 8.0 | 2.0 | 11.0 | 0.9 | 9.0 | 18.6 | 45.7 | 1.6 |
| 13 | 48.0 | 35.0 | 0.0 | 14.0 | 3.0 | 10.0 | 0.5 | 9.3 | 13.6 | 40.0 | 2.3 |
| 14 | 64.0 | 26.0 | 7.0 | 2.0 | 1.0 | 11.0 | 0.6 | 7.8 | 10.4 | 42.5 | 1.2 |
| 15 | 75.0 | 16.0 | 4.0 | 4.0 | 1.0 | 9.0 | 0.5 | 8.5 | 16.3 | 49.0 | 2.9 |
| 16 | 69.0 | 21.0 | 6.0 | 3.0 | 1.0 | 8.0 | 0.4 | 7.8 | 17.2 | 44.4 | 2.0 |

TABLE 3A-continued

| Manufacturing No. | Metallographic structure: Area % of tempered martensite + bainite | Area % of ferrite | Area % of pearlite | Area % of residual austenite | Area % of martensite | Average grain size μm | Average number density of iron-based carbides ($\times 10^6$) carbides/mm$^2$ | Ni concentraton on surface mass % | Average depth of internal oxide layer μm | Arithmetic average roughness of surface μm | Sheet thickness mm |
|---|---|---|---|---|---|---|---|---|---|---|---|
| 17 | 81.0 | 11.0 | 8.0 | 0.0 | 0.0 | 8.0 | 0.3 | 8.8 | 9.0 | 13.1 | 1.0 |
| 18 | 97.0 | 0.0 | 0.0 | 2.0 | 1.0 | 5.5 | 9.0 | 7.2 | 6.1 | 29.9 | 1.4 |
| 19 | 88.0 | 0.0 | 0.0 | 1.0 | 11.0 | 5.0 | 0.1 | 9.4 | 15.1 | 24.2 | 4.0 |

TABLE 3B

| Manufacturing No. | Metallographic structure: Area % of tempered martensite + bainite | Area % of ferrite | Area % of pearlite | Area % of residual austenite | Area % of martensite | Average grain size μm | Average number density of iron-based carbides ($\times 10^6$) carbides/mm$^2$ | Ni concentraton on surface mass % | Average depth of internal oxide layer μm | Arithmetic average roughness of surface μm | Sheet thickness mm |
|---|---|---|---|---|---|---|---|---|---|---|---|
| 20 | 80.0 | 0.0 | 0.0 | 16.0 | 4.0 | 4.0 | 9.0 | 9.5 | 19.6 | 47.2 | 0.8 |
| 21 | 89.0 | 0.0 | 0.0 | 9.0 | 2.0 | 5.5 | 3.0 | 8.4 | 11.2 | 35.5 | 1.6 |
| 22 | 82.0 | 0.0 | 0.0 | 15.0 | 3.0 | 3.5 | 1.0 | 9.0 | 17.7 | 43.5 | 3.6 |
| 23 | 84.0 | 0.0 | 0.0 | 14.0 | 2.0 | 2.5 | 4.0 | 9.3 | 15.4 | 47.0 | 1.8 |
| 24 | 82.0 | 0.0 | 0.0 | 15.0 | 3.0 | 3.0 | 3.5 | 7.7 | 6.2 | 33.0 | 2.6 |
| 25 | 93.0 | 0.0 | 0.0 | 6.0 | 1.0 | 5.5 | 1.5 | 7.8 | 17.2 | 17.3 | 2.9 |
| 26 | 84.0 | 0.0 | 0.0 | 14.0 | 2.0 | 4.5 | 8.0 | 9.7 | 19.1 | 24.7 | 0.8 |
| 27 | 92.0 | 0.0 | 0.0 | 7.0 | 1.0 | 5.5 | 1.5 | 9.7 | 18.1 | 18.9 | 2.9 |
| 28 | 93.0 | 0.0 | 0.0 | 6.0 | 1.0 | 6.0 | 1.0 | 9.1 | 16.3 | 47.2 | 1.8 |
| 29 | 90.0 | 0.0 | 0.0 | 8.0 | 2.0 | 5.0 | 1.5 | 9.3 | 17.2 | 19.2 | 3.2 |
| 30 | 89.0 | 0.0 | 0.0 | 9.0 | 2.0 | 4.0 | 7.0 | 7.8 | 8.6 | 30.0 | 4.0 |
| 31 | 93.0 | 0.0 | 0.0 | 6.0 | 1.0 | 5.0 | 1.0 | 7.9 | 5.4 | 40.1 | 2.3 |
| 32 | 87.0 | 0.0 | 0.0 | 11.0 | 2.0 | 6.0 | 4.0 | 8.5 | 5.8 | 33.4 | 2.3 |
| 33 | 75.0 | 22.0 | 0.0 | 2.0 | 1.0 | 7.0 | 0.5 | 9.4 | 13.3 | 26.3 | 1.6 |
| 34 | 55.0 | 35.0 | 10.0 | 0.0 | 0.0 | 11.0 | 0.1 | 9.1 | 16.6 | 17.2 | 2.9 |
| 35 | 93.0 | 0.0 | 0.0 | 6.0 | 1.0 | 5.0 | 1.0 | 0.4 | 1.6 | 4.8 | 2.6 |
| 36 | 91.0 | 0.0 | 6.0 | 2.0 | 1.0 | 5.0 | 5.0 | 9.7 | 10.5 | 15.2 | 3.2 |
| 37 | 60.0 | 35.0 | 0.0 | 1.0 | 4.0 | 9.0 | 0.4 | 8.3 | 17.1 | 35.0 | 3.2 |
| 38 | 88.0 | 4.0 | 0.0 | 7.0 | 1.0 | 6.5 | 2.0 | 7.2 | 18.5 | 31.1 | 2.0 |

TABLE 3C

| Manufacturing No. | Properties: Tensile strength MPa | Toughness vTrs ° C. | Ductility (JIS 5-C) % | Stretch flangeability (hole expansion value) % | Chemical convertibility (presence of lack of hiding) | Coating film adhesion (peeling width of peeling test) | Remarks |
|---|---|---|---|---|---|---|---|
| 1 | 1031 | −85 | 17.0 | 65 | OK | 0.9 | Invention Example |
| 2 | 1071 | −90 | 16.3 | 70 | OK | 1.0 | Invention Example |
| 3 | 981 | −80 | 17.8 | 75 | OK | 1.8 | Invention Example |
| 4 | 1035 | −85 | 16.9 | 58 | OK | 2.8 | Invention Example |
| 5 | 965 | −45 | 11.4 | 60 | NG | 4.2 | Comparative Example |
| 6 | 1028 | −80 | 17.0 | 58 | NG | 4.1 | Comparative Example |
| 7 | 1046 | −85 | 16.7 | 57 | NG | 7.1 | Comparative Example |
| 8 | 1030 | −80 | 17.0 | 59 | OK | 3.8 | Invention Example |
| 9 | 1028 | −85 | 17.0 | 60 | OK | 3.7 | Invention Example |
| 10 | 1051 | −80 | 16.7 | 56 | OK | 3.2 | Invention Example |
| 11 | 1044 | −85 | 16.8 | 57 | OK | 3.3 | Invention Example |
| 12 | 1102 | −40 | 15.9 | 55 | OK | 2.9 | Comparative Example |
| 13 | 890 | −45 | 19.7 | 38 | OK | 2.8 | Comparative Example |
| 14 | 912 | −45 | 11.8 | 35 | OK | 0.4 | Comparative Example |
| 15 | 945 | −40 | 11.0 | 32 | OK | 2.0 | Comparative Example |
| 16 | 924 | −45 | 11.6 | 31 | OK | 3.0 | Comparative Example |
| 17 | 886 | −40 | 11.2 | 35 | OK | 1.7 | Comparative Example |
| 18 | 996 | −80 | 10.0 | 60 | OK | 3.0 | Comparative Example |
| 19 | 1084 | −45 | 9.7 | 40 | OK | 2.0 | Comparative Example |

TABLE 3C-continued

| Manufacturing No. | Properties: Tensile strength MPa | Toughness vTrs ° C. | Ductility (JIS 5-C) % | Stretch flangeability (hole expansion value) % | Chemical convertibility (presence of lack of hiding) | Coating film adhesion (peeling width of peeling test) | Remarks |
|---|---|---|---|---|---|---|---|
| 20 | 1006 | −80 | 17.4 | 60 | OK | 2.6 | Invention Example |
| 21 | 988 | −75 | 17.7 | 61 | OK | 0.2 | Invention Example |
| 22 | 1356 | −80 | 13.1 | 46 | OK | 3.0 | Invention Example |
| 23 | 1273 | −95 | 13.7 | 47 | OK | 2.9 | Invention Example |
| 24 | 1207 | −90 | 14.5 | 49 | OK | 1.0 | Invention Example |
| 25 | 1006 | −75 | 17.4 | 61 | OK | 3.0 | Invention Example |
| 26 | 1260 | −60 | 13.9 | 48 | OK | 1.1 | Invention Example |
| 27 | 989 | −80 | 17.7 | 60 | OK | 0.8 | Invention Example |
| 28 | 1488 | −60 | 12.0 | 45 | OK | 0.5 | Invention Example |
| 29 | 1221 | −75 | 12.1 | 50 | OK | 0.1 | Invention Example |
| 30 | 1491 | −65 | 12.4 | 46 | OK | 1.7 | Invention Example |
| 31 | 1063 | −80 | 16.5 | 58 | OK | 2.3 | Invention Example |
| 32 | 1137 | −75 | 15.4 | 55 | OK | 0.3 | Invention Example |
| 33 | 988 | −45 | 11.1 | 55 | OK | 3.0 | Comparative Example |
| 34 | 1171 | −35 | 6.0 | 30 | OK | 2.0 | Comparative Example |
| 35 | 982 | −85 | 17.8 | 60 | NG | 7.8 | Comparative Example |
| 36 | 1371 | −55 | 9.0 | 50 | OK | 2.3 | Comparative Example |
| 37 | 789 | −50 | 10.3 | 65 | OK | 2.9 | Comparative Example |
| 38 | 996 | −65 | 17.6 | 55 | NG | 8.4 | Comparative Example |

INDUSTRIAL APPLICABILITY

According to the present invention, it is possible to provide a hot-rolled steel sheet which is an ultrahigh-strength steel sheet having a tensile strength of 980 MPa or more, and high press formability (ductility and stretch flangeability), and even in a case where a zirconium-based chemical conversion treatment liquid is used, has chemical convertibility and coating film adhesion equal to or higher than those in a case where a zinc phosphate chemical conversion treatment liquid is used. Since the steel sheet according to the present invention has excellent chemical convertibility and coating film adhesion, the steel sheet has excellent corrosion resistance after coating. In addition, excellent ductility and stretch flangeability are also obtained. Therefore, the present invention is suitable for a component for a vehicle that requires high strength, formability, and corrosion resistance after coating.

BRIEF DESCRIPTION OF THE REFERENCE SYMBOLS

1: base metal (steel sheet)
2: scale
3: Ni concentrated portion
4: zirconium-based chemical conversion crystal
5: grain boundary
6: internal oxide

What is claimed is:

1. A hot-rolled steel sheet comprising, as a chemical composition expressed by an average value in an entire sheet thickness direction, by mass %:

C: 0.100% to 0.250%;
Si: 0.05% to 3.00%;
Mn: 1.00% to 4.00%;
Al: 0.001% to 2.000%;
Ni: 0.02% to 2.00%;
Nb: 0% to 0.300%;
Ti: 0% to 0.300%;
Cu: 0% to 2.00%;
Mo: 0% to 1.000%;
V: 0% to 0.500%;
Cr: 0% to 2.00%;
Mg: 0% to 0.0200%;
Ca: 0% to 0.0200%;
REM: 0% to 0.1000%;
B: 0% to 0.0100%;
Bi: 0% to 0.020%;
one or two or more of Zr, Co, Zn, and W: 0% to 1.000% in total;
Sn: 0% to 0.050%;
P: 0.100% or less;
S: 0.0300% or less;
0: 0.0100% or less;
N: 0.1000% or less; and
a remainder including Fe and impurities,
wherein Expression (1) is satisfied,
in a case where a thickness is denoted by t, a metallographic structure at a t/4 position from a surface includes, by area fraction, 77.0% to 97.0% of bainite or tempered martensite, 0% to 5.0% of ferrite, 0% to 5.0% of pearlite, 3.0% or more of residual austenite, and 0% to 10.0% of martensite,
in the metallographic structure,
an average grain size excluding the residual austenite is 7.0 μm or less,
an average number density of iron-based carbides having a diameter of 20 nm or more is $1.0\times10^6$ carbides/$mm^2$ or more,
a tensile strength is 980 MPa or more,
and an average Ni concentration on the surface is 7.0% or more, $$0.05\% \leq Si+Al \leq 3.00\% \quad \text{Expression (1)}$$

where each element shown in Expression (1) indicates mass % of the element contained in the hot-rolled steel sheet.

2. The hot-rolled steel sheet according to claim 1,
wherein the hot-rolled steel sheet contains, as the chemical composition, by mass %,
Ni: 0.02% to 0.05%.

3. The hot-rolled steel sheet according to claim 1,
wherein an internal oxide layer is present in the hot-rolled steel sheet, and
an average depth of the internal oxide layer is 5.0 μm or more and 20.0 μm or less from the surface of the hot-rolled steel sheet.

4. The hot-rolled steel sheet according to claim 1,
wherein a standard deviation of an arithmetic average roughness Ra of the surface of the hot-rolled steel sheet is 10.0 μm or more and 50.0 μm or less.

5. The hot-rolled steel sheet according to claim 1,
wherein the hot-rolled steel sheet contains, as the chemical composition, by mass %, one or both of
V: 0.005% to 0.500%, and
Ti: 0.005% to 0.300%.

6. The hot-rolled steel sheet according to claim 1,
wherein the hot-rolled steel sheet contains, as the chemical composition, by mass %, one or two or more of
Nb: 0.005% to 0.300%,
Cu: 0.01% to 2.00%,
Mo: 0.01% to 1.000%,
B: 0.0001% to 0.0100%, and
Cr: 0.01% or more and 2.00% or less.

7. The hot-rolled steel sheet according to claim 1,
wherein the hot-rolled steel sheet contains, as the chemical composition, by mass %, one or two or more of
Mg: 0.0005% to 0.0200%,
Ca: 0.0005% to 0.0200%, and
REM: 0.0005% to 0.1000%.

8. A method for manufacturing a hot-rolled steel sheet according to claim 1, the method comprising:
heating a slab having the chemical composition according to claims 1 to 1150° C. or higher in a heating furnace which includes a regenerative burner and has at least a preheating zone, a heating zone, and a soaking zone;
hot-rolling the heated slab so that a finish temperature is T2° C., which is obtained by Expression (2), or higher and a cumulative rolling reduction in a temperature range of 850° C. to 1100° C. is 90% or more;
starting primary cooling within 1.5 seconds after the hot-rolling of the heated steel sheet and cooling the hot-rolled steel sheet to a temperature T3° C., which is represented by Expression (3), or lower at an average cooling rate of 50° C./sec or higher;
when a temperature represented by Expression (4) is T4° C., secondary cooling the steel sheet from a cooling stop temperature of the primary cooling to a coiling temperature of (T4−100)° C. to (T4+50)° C. at an average cooling rate of 10° C./sec or higher; and
coiling the steel sheet at the coiling temperature,
wherein in the heating of the slab, an air ratio in the preheating zone is 1.1 to 1.9, $$T2(^\circ\,C.)=868-396\times[C]-68.1\times[Mn]+24.6\times[Si]-36.1\times[Ni]-24.8\times[Cr]-20.7\times[Cu]+250\times[Al] \quad (2)$$

$$T3(^\circ\,C.)=770-270\times[C]-90\times[Mn]-37\times[Ni]-70\times[Cr]-83\times[Mo] \quad (3)$$

$$T4(^\circ\,C.)=591-474\times[C]-33\times[Mn]-17\times[Ni]-17\times[Cr]-21\times[Mo] \quad (4)$$

where an [element symbol] in each expression indicates the amount of each element in the slab by mass %.

9. The method for manufacturing a hot-rolled steel sheet according to claim 8,
wherein in the heating of the slab, an air ratio in the heating zone is 0.9 to 1.3.

10. The method for manufacturing a hot-rolled steel sheet according to claim 8,
wherein in the heating of the slab, an air ratio in the soaking zone is 0.9 to 1.9.

11. The method for manufacturing a hot-rolled steel sheet according to claim 8,
wherein the air ratio in the preheating zone is higher than the air ratio in the heating zone.

12. The method for manufacturing a hot-rolled steel sheet according to claim 8, further comprising:
pickling the hot-rolled steel sheet after the coiling of the steel sheet using a 1 to 10 mass % hydrochloric acid solution at a temperature of 20° C. to 95° C. under a condition of a pickling time of 30 seconds or more and less than 60 seconds.

13. The hot-rolled steel sheet according to claim 2,
wherein an internal oxide layer is present in the hot-rolled steel sheet, and
an average depth of the internal oxide layer is 5.0 μm or more and 20.0 μm or less from the surface of the hot-rolled steel sheet.

14. The method for manufacturing a hot-rolled steel sheet according to claim 9,
wherein in the heating of the slab, an air ratio in the soaking zone is 0.9 to 1.9.

15. The method for manufacturing a hot-rolled steel sheet according to claim 9,
wherein the air ratio in the preheating zone is higher than the air ratio in the heating zone.

* * * * *